US009825410B2

(12) United States Patent
Scritzky et al.

(10) Patent No.: US 9,825,410 B2
(45) Date of Patent: Nov. 21, 2017

(54) HIGH-SPEED CONNECTOR SYSTEM

(71) Applicant: Apple Inc., Cupertino, CA (US)

(72) Inventors: Robert Scritzky, Sunnyvale, CA (US); John Raff, Menlo Park, CA (US); Cuneyt Bakan, Santa Clara, CA (US); Eric T. SooHoo, Sunnyvale, CA (US); Erik A. Uttermann, San Francisco, CA (US); Patrick J. Quinn, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/260,271

(22) Filed: Sep. 8, 2016

(65) Prior Publication Data

US 2017/0133799 A1 May 11, 2017

Related U.S. Application Data

(60) Provisional application No. 62/215,573, filed on Sep. 8, 2015, provisional application No. 62/254,145, filed on Nov. 11, 2015.

(51) Int. Cl.
*H01R 13/66* (2006.01)
*H01R 13/658* (2011.01)
(Continued)

(52) U.S. Cl.
CPC ..... *H01R 13/665* (2013.01); *H01R 12/75* (2013.01); *H01R 13/405* (2013.01);
(Continued)

(58) Field of Classification Search
None
See application file for complete search history.

(56) References Cited

U.S. PATENT DOCUMENTS 7,549,896 B2 * 6/2009 Zhang ..... H01R 12/716 439/607.01
8,545,273 B1 * 10/2013 Chen ..... H01R 13/6658 439/660

(Continued)

FOREIGN PATENT DOCUMENTS

CN 204349135 U 5/2015
WO 2015/073974 A2 5/2015

OTHER PUBLICATIONS

International Search Report and Written Opinion dated Jan. 9, 2017 in PCT/US2016/050797, 21 pages.

*Primary Examiner* — Harshad Patel
(74) *Attorney, Agent, or Firm* — Kilpatrick Townsend & Stockton LLP

(57) ABSTRACT

Connector receptacles, examples of which comprise a housing having a first plurality of slots in a top side and a second plurality of slots in a bottom side, a top row of contacts positioned in the first plurality of slots in the housing, a bottom row of contacts positioned in the second plurality of slots in the housing, a top shell portion over the top of the housing, the top shell portion comprising first and second electromagnetic contacts extending from a front of the top shell and passing through openings in the top side of the housing, and a bottom shell portion under the bottom of the housing, the bottom shell portion comprising third and fourth electromagnetic contacts extending from a front of the bottom shell and passing through openings in the bottom side of the housing.

18 Claims, 30 Drawing Sheets

(51) Int. Cl.

| | |
|---|---|
| ***H01R 24/60*** | (2011.01) |
| ***H01R 24/62*** | (2011.01) |
| ***H01R 12/75*** | (2011.01) |
| ***H01R 13/405*** | (2006.01) |
| ***H01R 13/6477*** | (2011.01) |

(52) U.S. Cl.
CPC ..... *H01R 13/6477* (2013.01); *H01R 13/658* (2013.01); *H01R 24/60* (2013.01); *H01R 24/62* (2013.01)

(56) References Cited

U.S. PATENT DOCUMENTS

| | | | | |
|---|---|---|---|---|
| 8,764,492 | B2 * | 7/2014 | Chiang | H01R 13/05 439/676 |
| 8,777,666 | B2 * | 7/2014 | Golko | H01R 13/6594 439/607.34 |
| 8,911,262 | B1 * | 12/2014 | Leiba | H01R 24/60 439/660 |
| 9,255,123 | B2 * | 2/2016 | Katoh | A23L 33/19 |
| 9,362,682 | B2 * | 6/2016 | Chien | H01R 13/6581 |
| 2010/0303421 | A1 * | 12/2010 | He | G02B 6/3817 385/75 |
| 2012/0015561 | A1 * | 1/2012 | Tsai | H01R 24/60 439/660 |
| 2015/0072562 | A1 | 3/2015 | Little et al. | |
| 2015/0140868 | A1 | 5/2015 | Do et al. | |
| 2015/0214673 | A1 * | 7/2015 | Gao | H01R 13/6597 439/352 |

* cited by examiner

HIGH-SPEED CONNECTOR SYSTEM

CROSS-REFERENCES TO RELATED APPLICATIONS

This application claims priority to U.S. provisional patent application Nos. 62/215,573, filed Sep. 8, 2015, and 62/254,145, filed Nov. 11, 2015, which are incorporated by reference.

BACKGROUND

The number and types of electronic devices available to consumers have increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive and provide power and data using various cable assemblies. These cable assemblies may include connector inserts, or plugs, on one or more ends of a cable. The connector inserts may plug into connector receptacles on electronic devices, thereby forming one or more conductive paths for signals and power.

The connector receptacles may be formed of housings that typically at least partially surround and provide mechanical support for contacts. These contacts may be arranged to mate with corresponding contacts on the connector inserts to form portions of electrical paths between devices. These connector receptacles may be attached or otherwise fixed to device enclosures that surround an electronic device. These enclosures may be highly stylized for both aesthetic and functional reasons. For example, portions of the device enclosures may be sloped, curved, or have other non-orthogonal shapes. These enclosures may also be thin or narrow.

The curvature or size of these enclosures may make it difficult to fit a connector receptacle to the enclosure. Moreover, a resulting connector receptacle may be difficult to assemble. It may also be difficult to achieve high speeds with such connector receptacles.

The connector inserts may include contacts to mate with corresponding contacts on the connector receptacles. It may also be difficult to achieve high speeds with connector inserts.

Thus, what is needed are connector receptacles that may have a desired form factor to fit in a stylized device enclosure. It may also be desirable that these connector receptacles and corresponding connector inserts are also capable of high-speed performance. It may also be desirable to have circuitry associated with the connector inserts and connector receptacles that support these high speeds.

SUMMARY

Accordingly, embodiments of the present invention may provide connector receptacles that may have a desired form factor to fit in a stylized device enclosure. These stylized connector receptacles and corresponding connector inserts may also be capable of high-speed performance. Embodiments of the present invention may also provide circuitry for these connector inserts and connector receptacles that support these high speeds.

An illustrative embodiment of the present invention may provide a connector receptacle for use in enclosures that may be highly stylized for either or both aesthetic and functional reasons. This connector receptacle may include a housing having a top cover or shell portion having a raised portion to accept a connector insert. The top shell portion may taper to a lower portion where the connector receptacle may narrow to allow for the placement of other components in the electronic device. The connector receptacle may further include a housing having a lower row of contacts and an upper row of contacts. The upper row may include a step-down portion that allows the top shell portion to taper to a lower portion.

Another illustrative embodiment of the present invention may provide a connector receptacle that is capable of high-speeds. The top row of contacts may be held together using a first housing portion and the bottom row of contacts may be held together using a second housing portion. The first housing portion and the second housing portion may be secured to the housing using various interlocking features. These housing portions may secure the contacts in place relative to the housing. This arrangement may stand in contrast to convention connector receptacles where barbs are inserted into a housing to secure contacts in place relative to the housing. These barbs may form high-frequency stubs that may degrade signal integrity. By omitting these barbs, the performance of the connector receptacle at high frequency may be improved. Also, the top row of contacts may include a step-down portion as described above. This step down portion may include a step that transitions over a length of the contact in order to avoid sharp corners, which again may degrade signal integrity. By omitting these sharp corners, the performance of the connector receptacle at high frequency may be further improved.

Another illustrative embodiment of the present invention may provide a connector receptacle that is readily manufactured. The top shell portion may be joined to a bottom shell portion. The top shell portion and the bottom shell portion may each include electromagnetic interference (EMI) contacts extending from a front edge of the respective shell portion. These EMI contacts may make electrical contact with a shell or housing on a corresponding connector insert when the connector insert is inserted into the connector receptacle.

Another illustrative embodiment of the present invention may provide a connector insert that may be capable of high-speed performance. The form-factor of this connector insert may be the same or similar as a Lightning™ connector. In convention connector inserts, the pin-to-pin or contact-to-contact capacitance may reduce signal line impedance at high frequencies. This reduction in impedance may attenuate high-frequency components of signals being conveyed through the connector insert. The loss of these high-frequency components may slow edges of the signals and may degrade signal performance. Accordingly, embodiments of the present invention may provide connector inserts having a reduced contact-to-contact capacitance.

The contact geometries in a connector insert may be difficult to change. For example, the spacing between contacts may be difficult to increase since that would increase the width of the connector insert and the corresponding connector receptacle. A length of a contact may need to have a certain length to provide a sufficient wiping force during insertion and extraction. Also, the length and width may be fixed due to a specification in order to maintain interoperability. Instead of changing these geometries, an illustrative embodiment of the present invention may provide a connector insert having a lower dielectric constant for the material between contacts. This lower dielectric constant may reduce the contact-to-contact capacitance and improve the impedance of the signal contacts at high frequencies.

In an illustrative embodiment of the present invention, an air gap may be provided between adjacent contacts. This air gap may have a dielectric constant of approximately 1.0. In other embodiments of the present invention, an optional polytetrafluoroethylene (PTFE) gasket or tape layer may be placed between contacts. This PTFE layer may have a dielectric constant of approximately 2.0, which again may reduce the contact-to-contact capacitance and improve impedance of the signal contacts at high frequencies.

In an illustrative embodiment of the present invention, the air gap may be provided by a molded contact puck. A top molded contact puck may be placed on a top surface of a printed circuit board in a top side opening of a housing for the connector insert. The contact puck may have passages for contacts. The molded contact puck may have a rib that contacts a top surface of a printed circuit board and seals an air gap between adjacent contacts. The contacts and molded contact puck may be over-molded. The over-mold may be blocked by the rib such that the air gap is maintained. This process may be the same for a bottom molded contact puck.

Another illustrative embodiment of the present invention may provide circuitry for a connector receptacle. In general, the connector receptacle may include a top row of contacts for a universal serial bus 3.0 (USB 3.0) interface and the bottom row of contacts for a USB 2.0 interface. Circuitry for USB 3.0 signals may be connected to the top row of contacts and circuitry for USB 2.0 signals may be connected to the bottom row of contacts. When a connection to a USB 3.0 device is made, USB 3.0 signals may be present on the top row of the contacts and the bottom row of contacts may be used for the USB 2.0 signals that are part of a USB 3.0 interface. When a connection to a USB 2.0 device is made, USB 2.0 signals may be present on both the top row of the contacts and the bottom row of the contacts. The USB 2.0 interface may be a lightning or other type of interface. Accordingly, the connector receptacle may have a physical form factor that is similar to a lightning connector receptacle and may accept lightning connector inserts. When a USB 3.0 device is connected, a dongle that receives a USB 3.0 connector insert and provides a connector insert having a lightning form factor may be used. The dongle may include a plurality of multiplexers, an ID chip, and an authentication chip, which may be combined with the ID chip, the multiplexers, or both. In other embodiments of the invention, one or more of these circuits may be included in an accessory device. The accessory device may include a connection supporting USB 3.0 but having the lightning form factor.

In general, lightning connector inserts have the same contacts on a top side of a tongue as on a bottom side of the tongue. Since USB 2.0 signals may be present on the top row of contacts when a USB 2.0 connection is made, the USB 2.0 signals may be provided to the USB 3.0 circuits. This may cause the USB 2.0 signals to be routed an extra distance, which may create stubs in the signal path that may degrade high-frequency performance. Accordingly, a plurality of switches may be provided near the top row of contacts. These switches may open thereby disconnecting the top row of contacts from the USB 3.0 circuits when USB 2.0 signals are being received to improve signal integrity of the USB 2.0 signals. When the switches are closed for USB 3.0 signals, the top row of contacts may be connected to a USB 3.0 controller. When a connector insert is removed from the connector receptacle, the removal may be detected and the switches may open, thereby protecting the USB 3.0 controller from transients on the top row of connector receptacle contacts.

This connector receptacle may be able to connect to and power either USB 2.0 or USB 3.0 accessories. Accordingly, an illustrative embodiment of the present invention may provide power circuitry such that power may be provided to either USB 2.0 or USB 3.0 accessories. In these and other embodiments of the present invention, a first power source may provide power to a USB 2.0 accessory. When power for a USB 3.0 accessory is needed, a second power source may replace or may be added to the first power source. In these and other embodiments of the present invention, power may also be received at the connector receptacle. In these and other embodiments of the present invention, power may be received at a first contact and provided at a second contact at the same time.

In these and other embodiments of the present invention, a connector insert that may be plugged into this connector receptacle may be rotatable. Since the connector insert that plugs into this connector receptacle is rotatable, the cable may include circuitry to ensure that USB 3.0 signals are always received at the top row of contacts in the connector receptacle and that USB 2.0 signals are always received at the top and bottom rows of contacts in the connector receptacle.

A plurality of multiplexers may be connected in the device to the bottom row of contacts of the connector receptacle. A controller circuit or other circuitry associated with the multiplexers may communicate with controllers in the cable insert that plugs into this connector receptacle. A top row controller may be associated with a top row of contacts in the connector insert and a bottom row controller may be associated with a bottom row of contacts in the connector insert. When a USB 3.0 device is connected and the bottom row controller in the connector insert is able to communicate with the multiplexer controller, the bottom row controller determines that the connector insert is inserted into the connector receptacle in a straight or non-rotated configuration, that is, the connector insert is not rotated. When a USB 3.0 device is connected and the top row controller in the connector insert is able to communicate with the multiplexer controller, the top row controller determines that the connector insert is inserted into the connector receptacle in a rotated configuration. The top row controller may then instruct a crossbar in the connector insert to flip and mirror the signal connections to the contacts of the connector insert. This effectively rotates the connector insert and places the USB 3.0 signals on the top row of contacts of the connector receptacle and the USB 2.0 signals on the bottom row of contacts of the connector receptacle.

When a USB 2.0 device, such as a lightning device, is connected, the top and bottom signal contacts in the connector insert may be shorted together in one of at least two patterns. The USB 2.0 or lightning signals may then be received on both the top row and bottom row of contacts in the connector receptacle. The switches connected to the top row of contacts may open. The multiplexer controller circuit may either pass the USB 2.0 or lightning signals through unchanged if the connector insert is not rotated, or may reorder the USB 2.0 or lightning signals received on the bottom row of contacts of the connector receptacle if the connector insert is rotated.

In various embodiments of the present invention, the components of the connector receptacles and connector inserts may be formed in various ways of various materials. For example, contacts and other conductive portions may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the receptacle housings, contact pucks, and other portions, may be formed using injection or other molding, 3-D printing, machining, or other manufacturing process. The nonconductive portions may be formed of silicon or silicone, Mylar, Mylar tape, rubber, hard rubber, plastic, nylon, elastomers, liquid-crystal polymers (LCPs), ceramics, or other nonconductive material or combination of materials.

Embodiments of the present invention may provide connector receptacles and connector inserts that may be located in, and may connect to, various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These connector receptacles and connector inserts may provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these connector receptacles and connector inserts may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
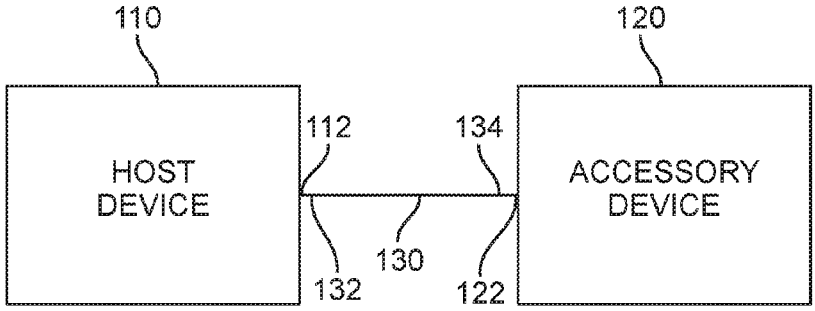
FIG. 1 illustrates an electronic system according to an embodiment of the present invention.

FIG. 1 illustrates an electronic system according to an embodiment of the present invention. This figure, as with the other included figures, is shown for illustrative purposes and does not limit either the possible embodiments of the present invention or the claims.

In this example, host device 110 may be connected to accessory device 120 in order to share data, power, or both. Specifically, connector receptacle 112 on host device 110 may be electrically connected to connector receptacle 122 on accessory device 120. Connector receptacle 112 on host device 110 may be electrically connected to connector receptacle 122 on accessory device 120 via cable 130 and connector inserts 132 and 134.

Figure 2:
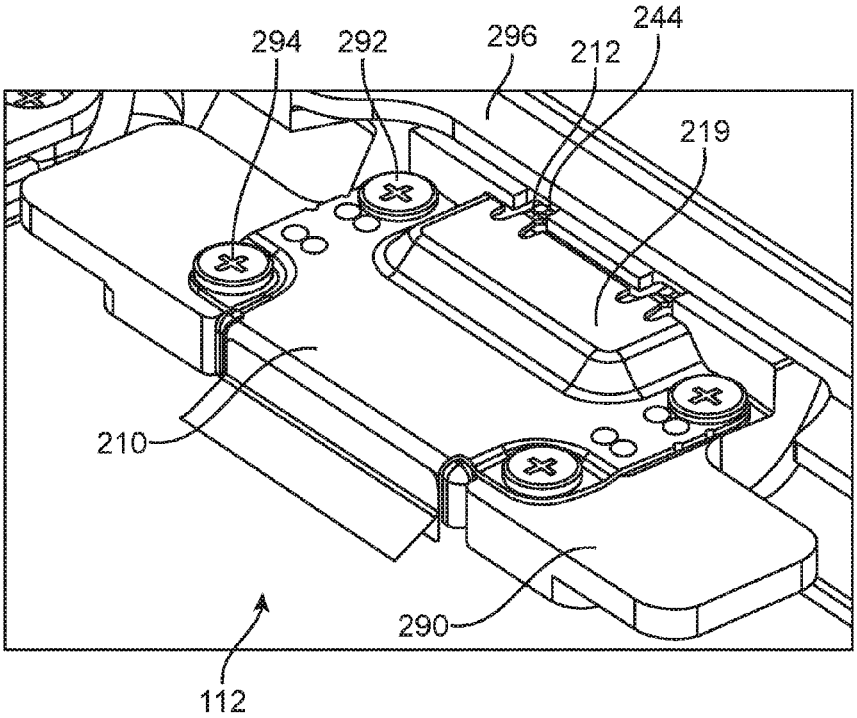
FIG. 2 illustrates a portion of an electronic device according to an embodiment of the present invention.

FIG. 2 illustrates a portion of an electronic device according to an embodiment of the present invention. This figure illustrates connector receptacle 112 in a housing or enclosure 296 for an electronic device. The electronic device may be an electronic device such as host 110 or accessory 120 in FIG. 1. The receptacle may be a receptacle such as receptacle 112 in host 110 or receptacle 122 in accessory 120 in FIG. 1.

Connector receptacle 112 may be in device enclosure 296. An opening (not shown) of connector receptacle 112 may be available at a front of enclosure 296. A corresponding connector insert may be inserted into the opening of connector receptacle 112. Connector receptacle 112 may include a top shell portion 210. Top shell portion 210 may have a tapered portion leading to a raised surface 219. Raised surface 219 may provide a wider opening for a connector insert while the narrower remaining portion of connector receptacle 112 may provide space for a second electronic component. This second electronic component may be a transceiver, a processor, a user actuated interface such as a button, or other electrical component.

Connector receptacle 112 may be attached to mounting surface 290. Front screws 292 may secure top shell portion 210 to mounting surface 290. Rear screws 294 may pass through the top shell portion 210 and mounting surface 290, and be threaded into standoffs attached to device enclosure 296. This may secure receptacle 112 and mounting surface 290 to device enclosure 296. Mounting surface 290 may further be glued to an inside surface of device enclosure 296. Conductive foam (not shown) or other pliant and conductive pieces may be located between mounting surface 290 and the second component. The second component may include a shield or other conductive structure to attach to the conductive foam. The shield or other conductive structure for the second component may be grounded directly or indirectly to device enclosure 296.

When a connector insert is inserted into connector receptacle 112, it may be desirable to form a ground path between top shell portion 210 and a conductive housing or shell of the connector insert. Accordingly, embodiments of the present invention may provide EMI contacts 212 that may extend from a front of top shell portion 210. EMI contacts 212 may fit in openings 244 in a housing for connector receptacle 112. When a connector insert is inserted into connector receptacle 112, EMI contacts 212 may electrically connect to a shell or housing of the connector insert. In these in other embodiments of the present invention, a similar configuration for a bottom shell portion (not shown) may be employed. Further details of connector receptacle 112 are shown in the following figures.

Figure 3:
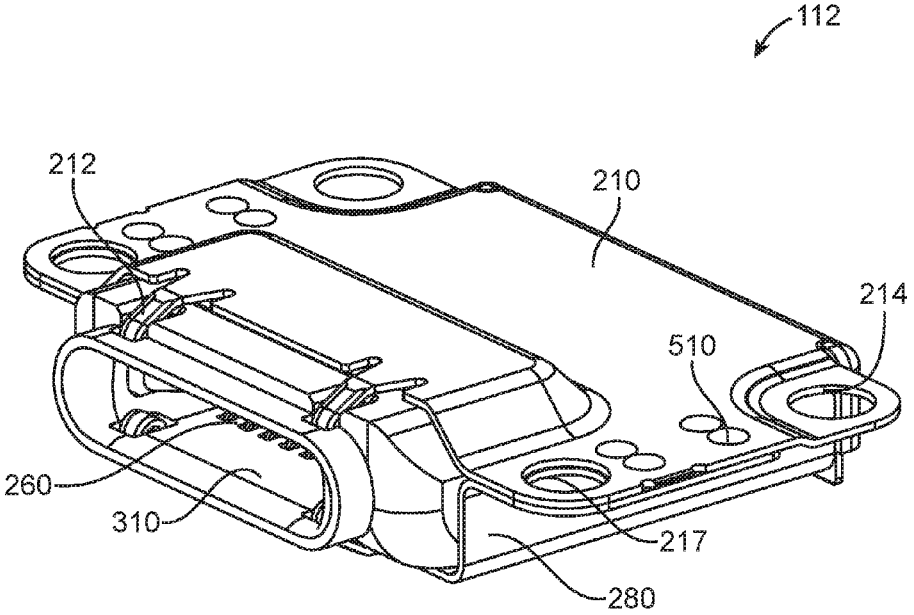
FIG. 3 illustrates a connector receptacle according to an embodiment of the present invention.

FIG. 3 illustrates a connector receptacle according to an embodiment of the present invention. Connector receptacle 112 may include top shell portion 210 and bottom shell portion 280. Top shell portion 210 and bottom shell portion 280 may be spot or laser welded together at points 510. Connector receptacle 112 may include opening 310 which may accept a corresponding connector insert. Contacts 260 may be accessible at front opening 310. EMI contacts 212 may extend from a front of top shell portion 210. Top shell portion 210 may include openings 214 for accepting fasteners 294 as shown in FIG. 2. Top shell portion 210 and bottom shell portion 280 may include openings 217 for accepting fasteners 292 as shown in FIG. 2.

Figure 4:
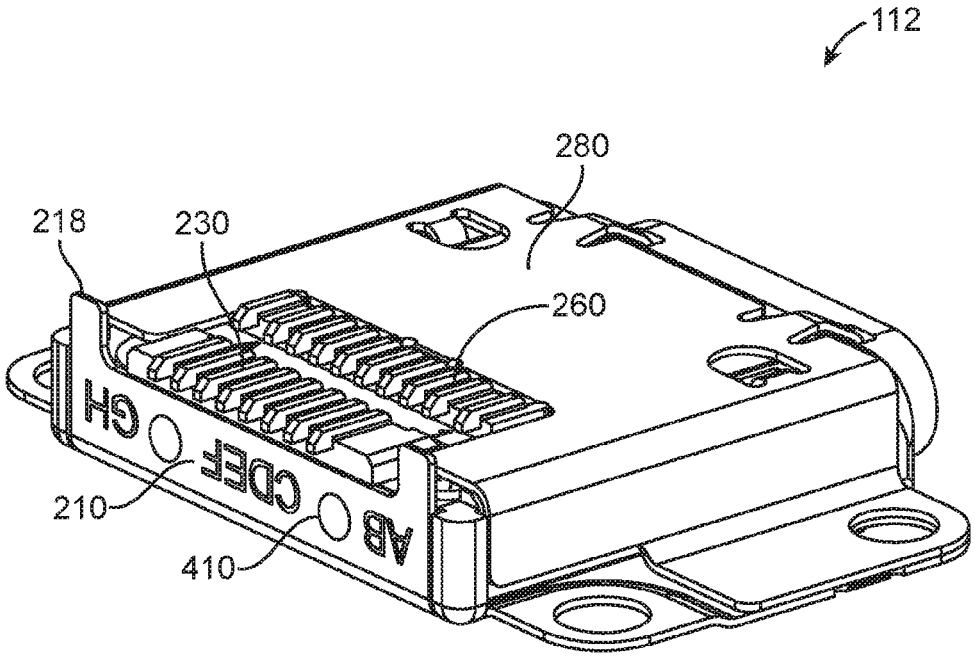
FIG. 4 is under side view of the connector receptacle of FIG. 3.

FIG. 4 is under side view of the connector receptacle of FIG. 3. Again, connector receptacle 112 may include a top shell portion 210 and a bottom shell portion 280. Portions of contacts 260 and 230 may be exposed at an underside of connector receptacle 112. These contacts may terminate in surface mount contacting portions as shown. In other embodiments of the present invention, contacts 230 and 260 may terminate in through-hole contacting portions, or they may terminate in a mix of surface-mount and through-hole contacting portions. Top shell portion 210 may include tabs 218. Tabs 218 may be inserted into corresponding openings in a printed circuit board or other appropriate substrate. These tabs may be soldered to ground in this way. Top shell portion 210 may be electrically connected to a latch (shown below) by spot or laser welding at points 410.

Figure 5:
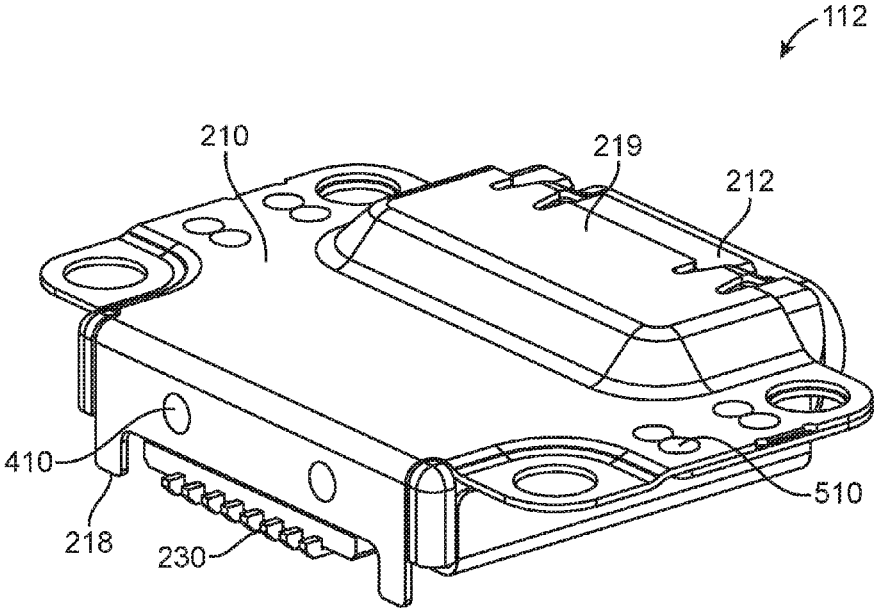
FIG. 5 illustrates a rear view of the connector receptacle of FIG. 3.

FIG. 5 illustrates a rear view of the connector receptacle of FIG. 3. As before, top shell portion 210 may have a tapered portion leading to raised portion 219. EMI contacts 212 may extend from a front of top shell portion 210. Top shell portion 210 may include tabs 218. Surface mount contact portions of contacts 230 may emerge from an underside of connector receptacle 112. Top shell portion 210 and bottom shell portion 280 may be connected together by spot or laser welding at points 510. Top shell portion 210 and a latch may be connected by spot or laser welding at points 410.

Figure 6:
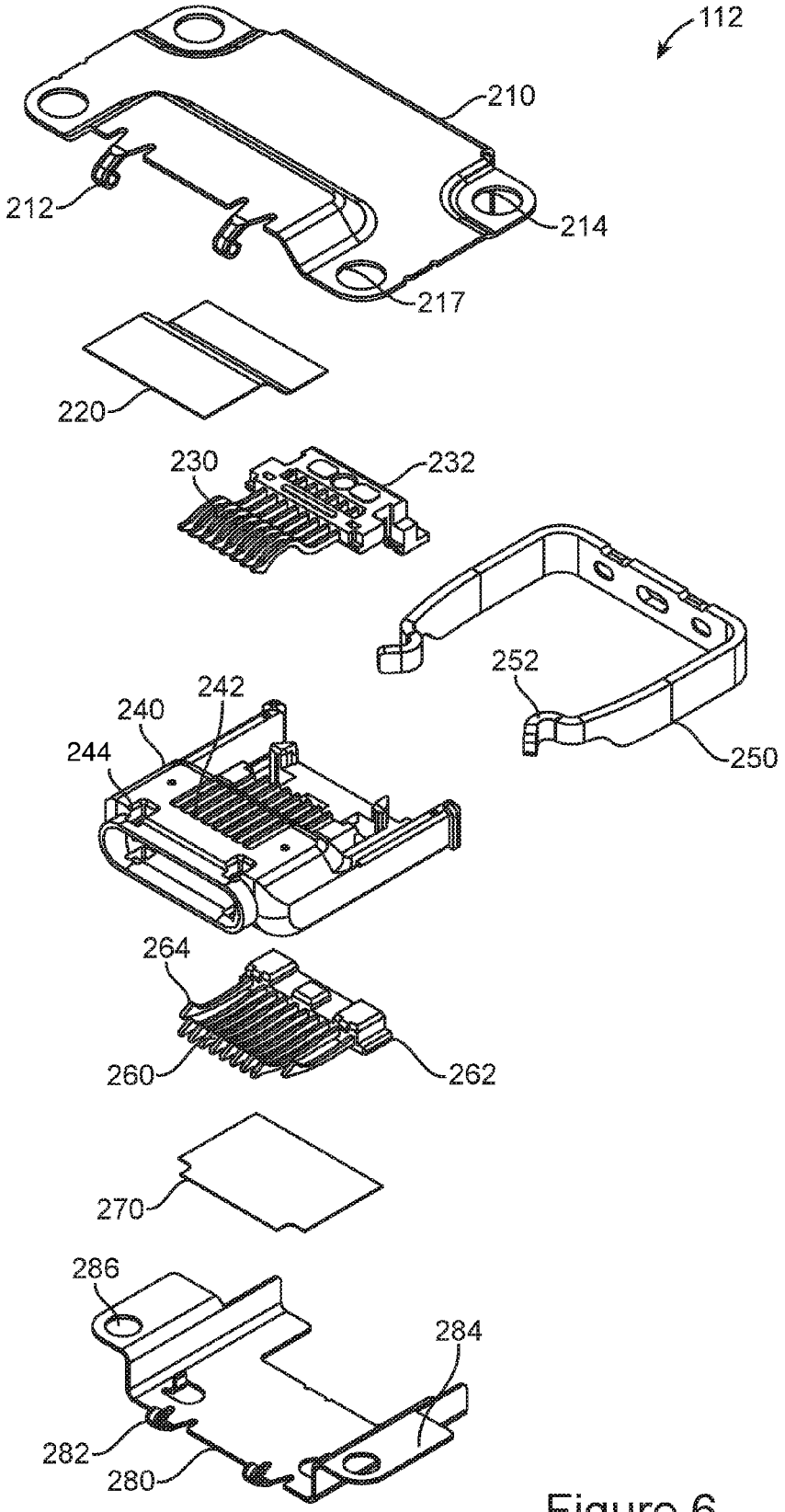
FIG. 6 illustrates an exploded view of the connector receptacle of FIG. 3.

FIG. 6 illustrates an exploded view of the connector receptacle of FIG. 3. Top shell portion 210 may have a tapered portion leading to a raised portion 219. EMI contacts 212 may emerge from a front portion of top shell portion 210. Top shell portion 210 may include openings 214 and 217 for accepting fasteners which may secure her connector receptacle 112 to a device enclosure as shown in FIG. 2. Top shell portion 210 may be formed by printing, machining, by using a deep drawn process, by stamping, or by other techniques. Housing 240 may include a number of top slots 242 and a number of bottom slots (not shown.) Contacts 230 may be at least partially surrounded by housing portion 232, while contacts 260 and 264 may be at least partially surrounded by housing portion 262. Contacts 230 may be placed in slots 242 in housing 240. Contacts 260 may be inserted into slots (not shown) in a bottom of housing 240. Housing portions 232 and 262 and housing 240 may include interlocking features which may secure the three housing portions together. Latch 250 may be inserted in a rear of housing 240. Latch 250 may include contacting portions 252 that may be located in side openings (not shown) of housing 240 for mating with sides of a connector insert when the connector insert is inserted into this connector receptacle. Bottom shell portion 280 may be attached to top shell portion 210 as described above. Bottom shell portion 280 may include extensions 284 having openings 286 to align to openings 217 in top shell portion 210. EMI contacts 282 may emerge from a front portion of bottom shell portion 280. Insulating layers 220 and 270 may isolate contacts 230 and 260 from top shell portion 210 and bottom shell portion 280 respectively. Insulating layers 220 and 270 may be tape, such as Kapton tape or other type of tape or insulating material such that contacts 230 and 260 do not electrically contact top shell portion 210 or bottom shell portion 280 during device use.

Again, top shell portion 210 may include a tapered portion leading to raised portion 219. Raised portion 219 may provide a sufficiently wide opening to receive a corresponding connector insert. By having a narrower, rear portion, space may be made available for a second component. This step down may require a similar step down in the shape of contacts 230. However, it may be undesirable to have sharp corners on contacts 230. Such sharp corners may be generate EMI and the degrade signal quality. Accordingly, contacts 230 may have a relatively smooth curvature to them leading to a step down corresponding to the step down in top shell portion 210.

Moreover, contacts 230 and 260 may not need to include barbs or other features, which may often be used to facilitate insertion of the contacts into housing 240. Instead, housing portions 232 and 262 may be used to secure contacts 230 and 260 to housing 240. Housing portions 232 and 262 may include interlocking features that may secure housing portions 232 and 262 to housing 240.

Again, EMI contacts 212 and 282 may be formed as part of top shield 210 and bottom shield 280, respectively. These EMI contacts 212 and 282 may pass through openings 244 in housing 240 and may contact a shell or shield of a connector insert when the connector insert is inserted into connector receptacle 112. This may simplify the manufacture of EMI contacts 212 and 282 and improve the manufacturability of connector receptacle 112.

The shape of contacts 230 and the presence of EMI contacts 212 and 282 may improve high-frequency performance of connector receptacle 112. Other techniques may be used to improve the high-frequency performance of connector inserts, such as connector insert 132, which may be inserted into connector receptacle 112. Examples are shown in the following figures.

Figure 7:
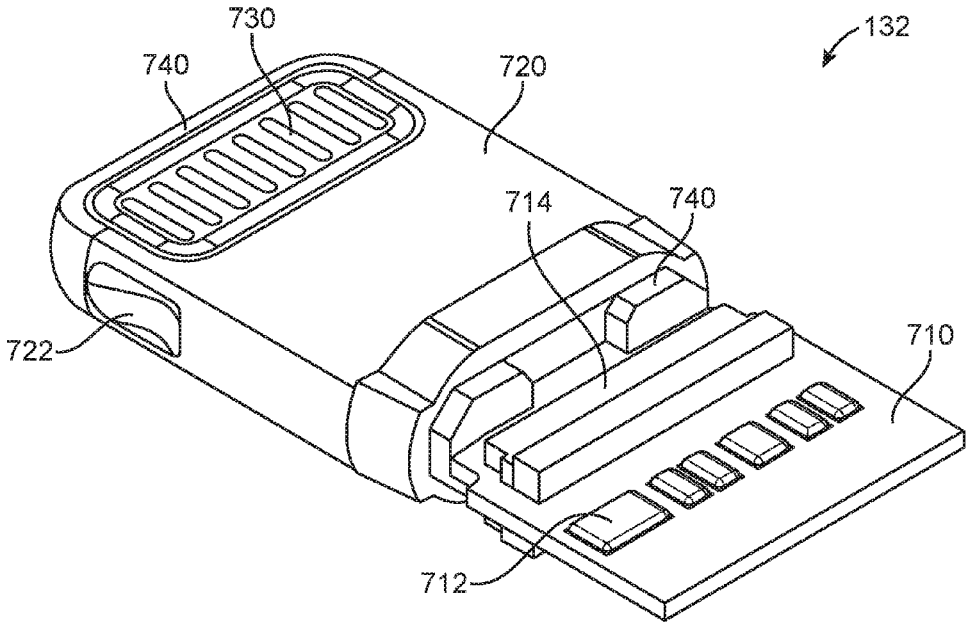
FIG. 7 illustrates a connector insert according to an embodiment of the present invention.

FIG. 7 illustrates a connector insert according to an embodiment of the present invention. The form-factor of this connector insert may be the same or similar as a Lightning connector. Connector insert 132 may include a printed circuit board 710 located in housing 720. Housing 720 may be conductive. A number of components 712 may be located on printed circuit board 710. Components 712 may be over-molded to form one or more structures 714. Contacts 730 may be located in a top side opening in housing 720. Contacts 730 may be located in a nonconductive over-mold portion 740. Side retention features 722 may be located on sides of housing 720.

It may be desirable to reduce the contact-to-contact capacitance between contacts 730 in order to improve the high-frequency performance of connector insert 132. If the contact-to-contact capacitance is excessive, the capacitance may provide a reduced impedance at high frequencies. Accordingly, high-frequency components of signals being conveyed on contacts 730 may be attenuated. This attenuation of frequency signal components may degrade the integrity of signals using connector insert 132.

Accordingly, embodiments of the present invention may reduce the contact-to-contact capacitance between contacts 730. An embodiment of the present invention may achieve this by providing an air gap between adjacent contacts 730. This air gap may have a dielectric constant of 1.0, which may lead to a reduced contact-to-contact capacitance. In other embodiments of the present invention, an optional layer, such as a PTFE layer having a dielectric constant of 2.0 may be used to reduce the contact-to-contact capacitance. In various embodiments of the present invention, the PTFE layer may be impregnated with air to further reduce its dielectric constant. An exploded view of such a connector insert is shown in the following figure.

Figure 8:
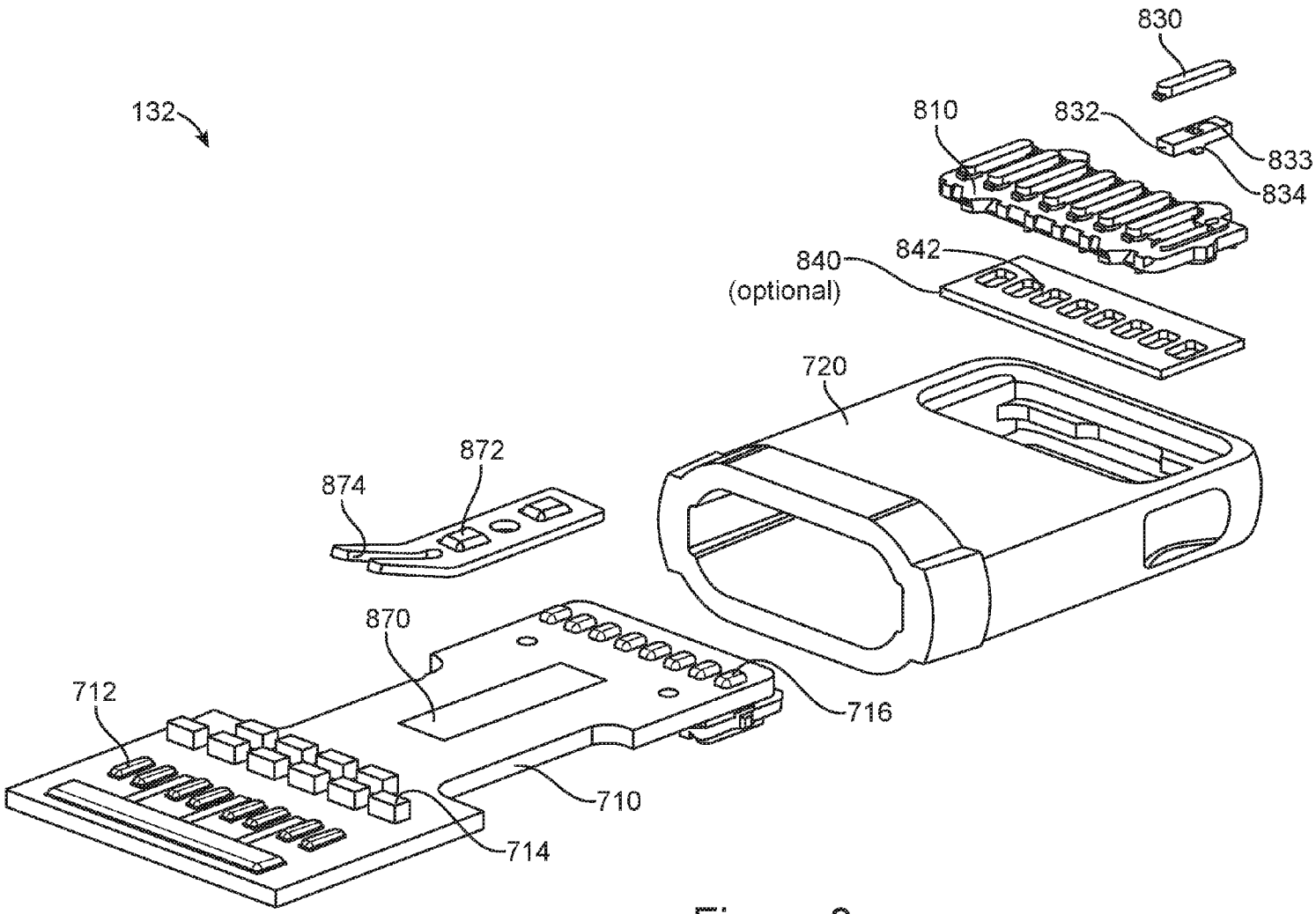
FIG. 8 illustrates an exploded view of a connector insert according to an embodiment of the present invention.

FIG. 8 illustrates an exploded view of a connector insert according to an embodiment of the present invention. Connector insert 132 may include a printed circuit board 710 having a number of printed contacts 716. Printed contacts and 16 may electrically connect to contacts in a top side opening of housing 720. Printed circuit board 710 may further include printed contacts 712. Printed contacts 712 may electrically connect to conductors in a cable, such as cable 130, an adapter, or a dongle. Printed circuit board 710 may further include components 714, which may be over-molded or potted for protection against moisture. A standoff 872 having prongs 874 may be soldered to pads 870 on printed circuit board 710. Standoff 872 may assist in positioning the printed circuit board 710 in housing 720 and may electrically connect housing 720 to a ground connection for printed circuit board 710.

Molded contact puck 810 may be placed in a top side opening and housing 720 such that it is located on a top surface of printed circuit board 710. An optional PTFE layer 840 having openings 842 may be positioned between contact puck 810 and printed circuit board 710. Contacts 730 (as shown in FIG. 7) may be formed of top contact portions 830 and bottom contact portions 832. Bottom contact portion 832 may include opening 833 and bottom contacting portion 834. Bottom contacting portions 834 may be soldered to contact pads 716 on printed circuit board 710. Contact puck 810 may provide air gaps between portions of top contact portion 830 or bottom contact portion 832, or both. In a specific embodiment of the present invention, air gaps may be formed between bottom contacting portions 834.

Figure 9:
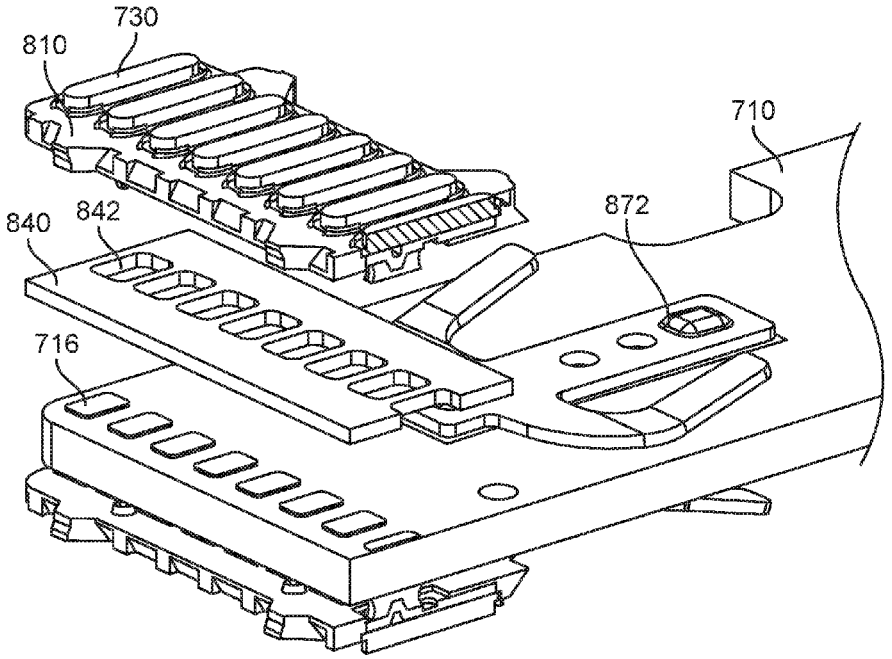
FIG. 9 is a close-up view of an exploded portion of a connector insert according to an embodiment of the present invention.

FIG. 9 is a close-up view of an exploded portion of a connector insert according to an embodiment of the present invention. Again, molded contact puck 810 may support a number of contacts 730. An optional PTFE layer 840 having openings 842 may be included or omitted in various embodiments of the present invention. Printed circuit boards 710 may support standoff 872 and printed contacts 716. Printed contacts 716 may be soldered to bottom contacting portions (not shown) of contacts 730. Molded contact puck 810 may provide air gaps between bottom portions of contacts 730.

Figure 10:
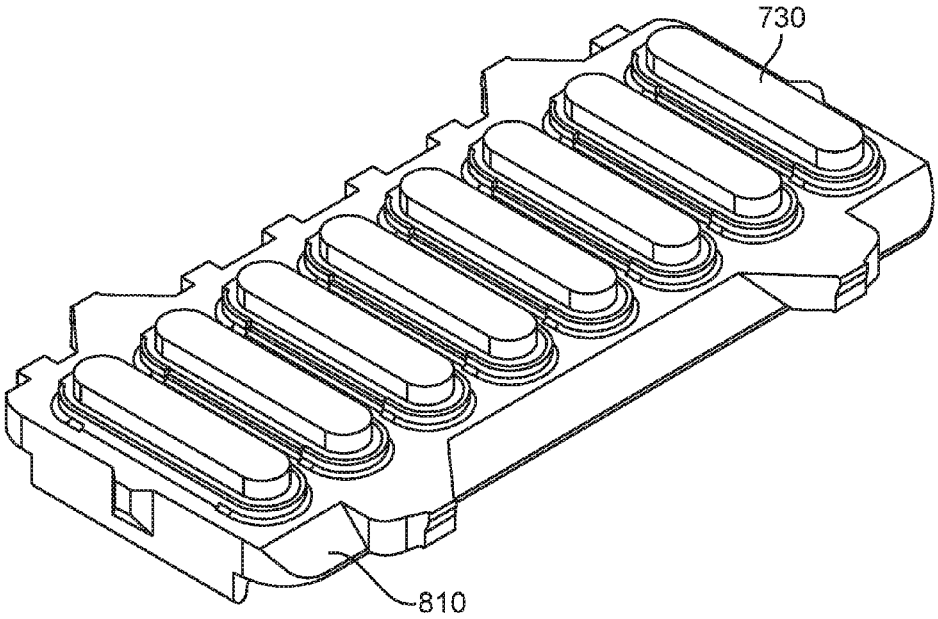
FIG. 10 illustrates a close-up view of a contact puck according to an embodiment of the present invention.

FIG. 10 illustrates a close-up view of a contact puck according to an embodiment of the present invention. Contact puck 810 may support a number of contacts 730.

Figure 11:
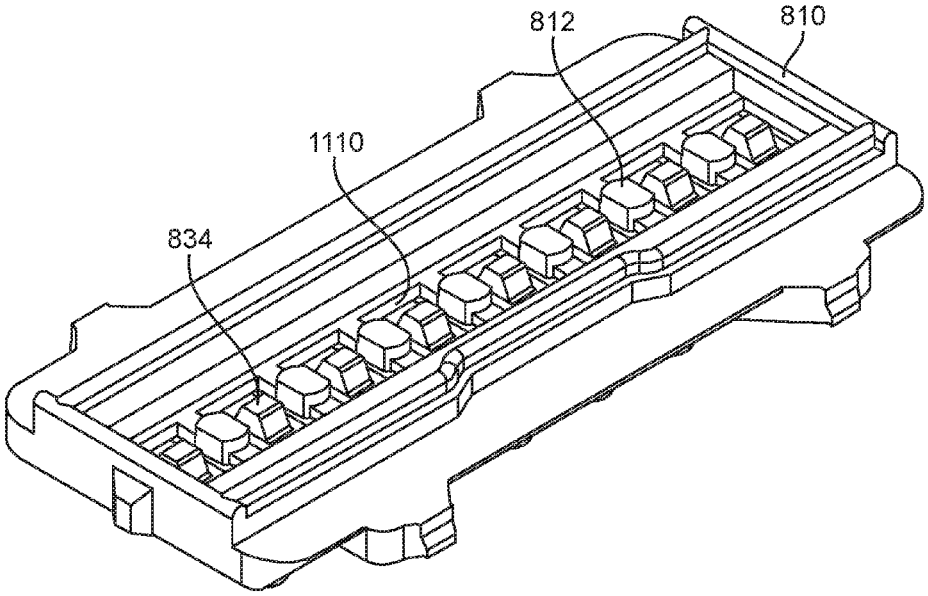
FIG. 11 illustrates a bottom side view of a contact puck according to an embodiment of the present invention.

FIG. 11 illustrates a bottom side view of a contact puck according to an embodiment of the present invention. In this example, contact puck 810 may include bottom contacting portions 834 for a number of contacts. An air gap 1110 may be provided between bottom contacting portions 834. Cross supports 812 may be located between contacts 834. Again, these air gaps may reduce the dielectric constant between adjacent contacts thereby reducing the contact-to-contact capacitance. This reduction in contact-to-contact capacitance may help to increase signal path impedance through the connector insert 132 thereby improving signal quality and integrity.

Figure 12:
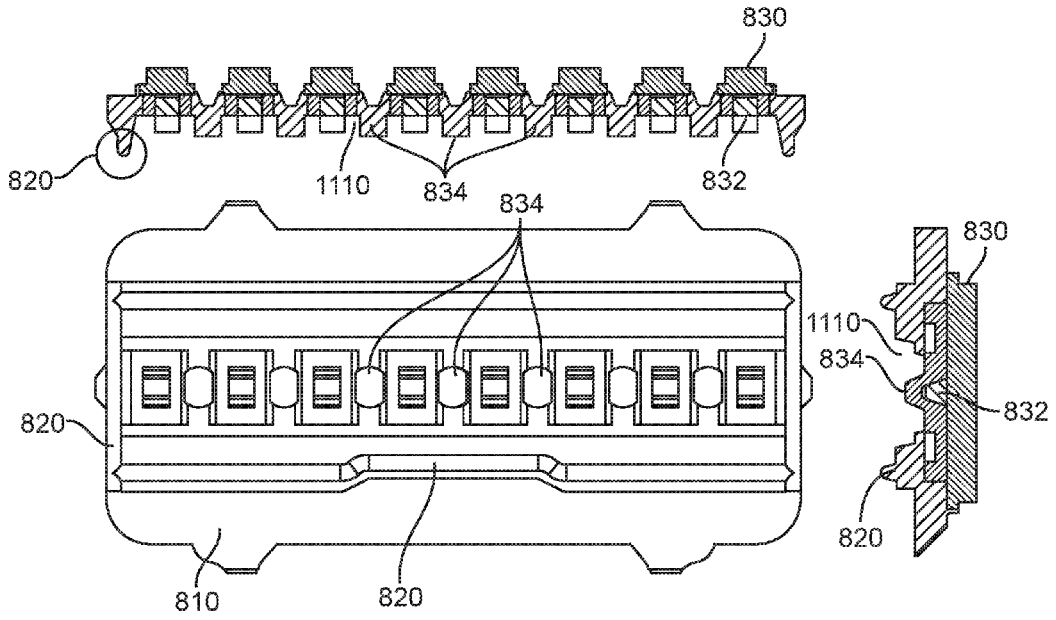
FIG. 12 illustrates bottom and side views of a molded contact puck supporting a number of contacts according to an embodiment of the present invention.

FIG. 12 illustrates bottom and side views of a molded contact puck supporting a number of contacts according to an embodiment of the present invention. Contact puck 810 may support a number of contacts having a top contact portion 830 and a bottom contact portion 832, the bottom contact portion 832 having a bottom contacting portion 834. Air gaps 1110 may be located between bottom contacting portions 334. A rib 820 may be placed around bottom contacting portion 334. Rib 820 may be a crush rib that may form a dam to block the ingress of over-mold 740 during an over-mold procedure. An example is shown in the following figures.

Figure 13:
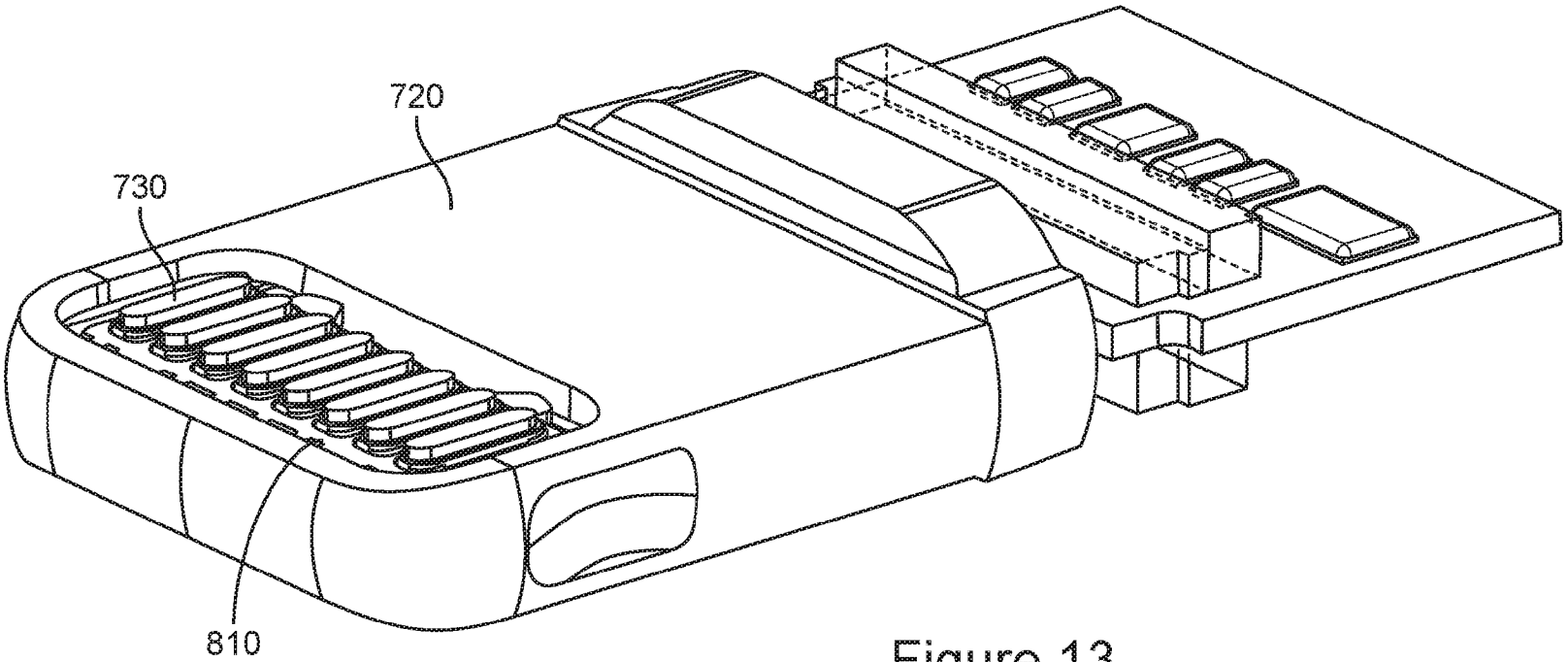
FIG. 13 illustrates a connector insert according to an embodiment of the present invention before and after an over-mold procedure has taken place.

FIG. 13 illustrates a connector insert according to an embodiment of the present invention before and after an over-mold procedure has taken place. Connector insert 132 may include housing 720 having a top side opening for contact puck 810. Contact puck 810 may support a number of contacts 730.

Figure 14:
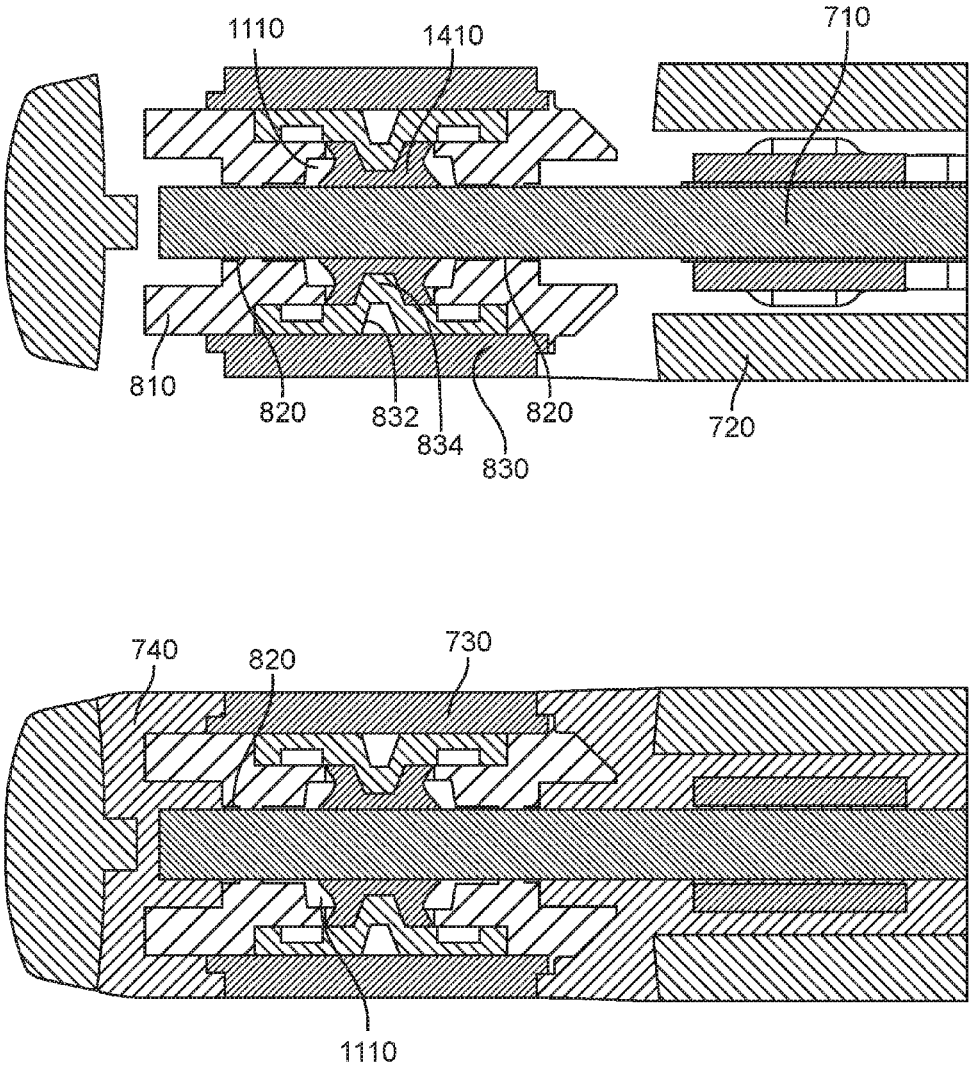
FIG. 14 illustrates a side view of a connector insert according to an embodiment of the present invention before and after an over-mold procedure.

FIG. 14 illustrates a side view of a connector insert according to an embodiment of the present invention before and after an over-mold procedure. Contact puck 810 may be in contact with a surface of printed circuit board 710. Rib 820 may be adjacent to printed circuit board 710. Each contact 730 may include a top contact portion 830 and a bottom contact portion 832. Bottom contact portion 832 may include bottom contacting portion 834. Bottom contacting portions 834 may be soldered to printed circuit board at solder areas 1410.

After overmold 740 is applied, rib 820 may act as a dam blocking the flow of over-mold 740 into air gaps 1110.

Various embodiments of the present invention may utilize different contact pucks. An example is shown in the following figure.

Figure 15:
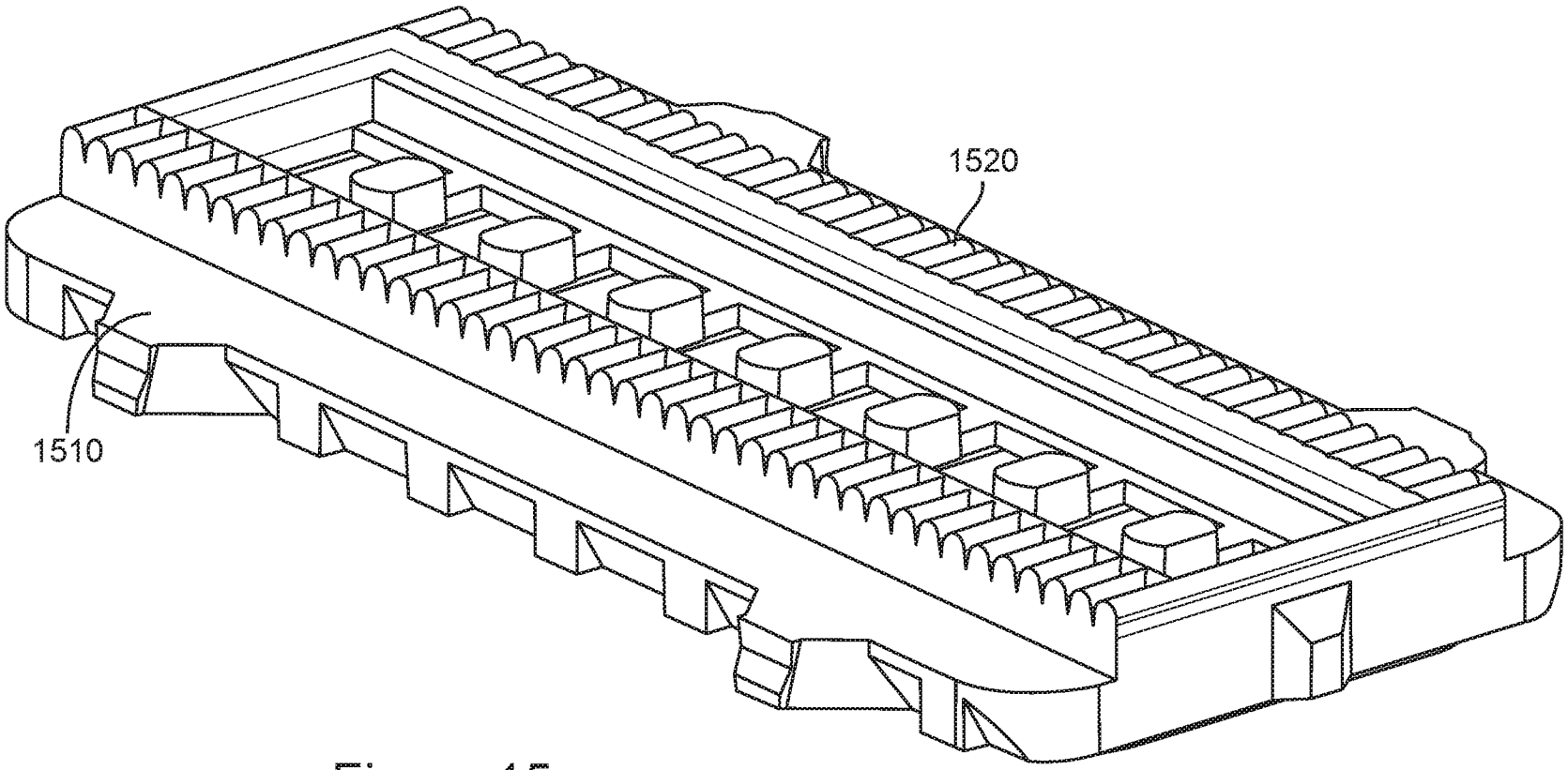
FIG. 15 illustrates another contact puck according to an embodiment of the present invention.

FIG. 15 illustrates another contact puck according to an embodiment of the present invention. In this example, contact puck 1510 may include a castellated pattern 1520 in place of rib 820.

In various embodiments of the present invention, connector receptacle 112 and connector insert 132 may be capable of carrying signals for various types of communication interfaces. In a specific embodiment of the present invention, connector receptacle 112 and connector insert 132 may be cable of conveying either USB 2.0 or USB 3.0 signals. The USB 2.0 signals may be part of an interface, such as a lightning interface, or some of all of the USB 2.0 signals may be used as part of the USB 3.0 interface, since a USB 3.0 interface includes USB 2.0 signals. An example of circuitry that may be used with such a connector receptacle is shown in the following figure.

Figure 16:
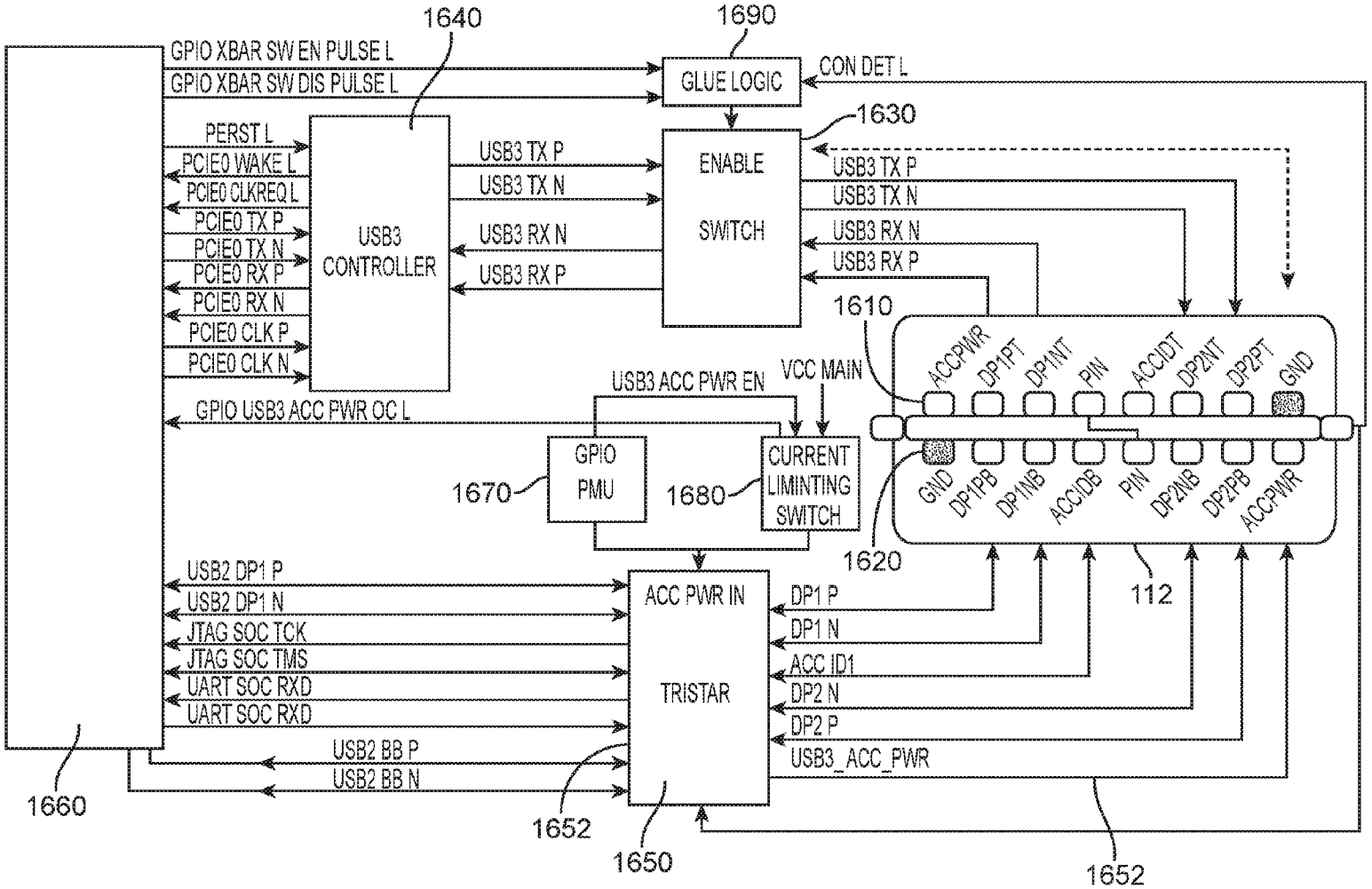
FIG. 16 illustrates connector receptacle circuitry according to an embodiment of the present invention.

FIG. 16 illustrates connector receptacle circuitry according to an embodiment of the present invention. This circuitry may be located in an electronic device such as host 110. In general, connector receptacle 112 may include a top row of contacts 1610 for a USB 3.0 interface, while a bottom row of contacts 1620 may include contacts for a USB 2.0 interface. The USB2 interface may be an interface such as Lightning or other interface. Some or all of the USB 2.0 contacts may be part of the USB 3.0 interface, along with the top row of contacts 1610.

When a USB 3.0 signals are received, contacts 1610 may provide the signals to switches 1630. Switches 1630 may be closed, thereby connecting contacts 1610 to USB controller 1640. USB controller 1640 may communicate with core logic 1660. Various ones of the contacts 1620 may provide USB 2.0 signals to multiplexers 1650, which may pass them to core logic 1660.

When a connector insert that has been providing USB 3.0 signals is removed, it may be desirable to disconnect or open switches 1630 in order to protect the USB controller 1640 from transient voltages that may occur on contacts 1610 of connector receptacle 112. Accordingly, glue logic 1690 may detect that a connection to a ground contact on the connector receptacle has been broken, and may open the switches 1630 in response. The ground contact may be a regular ground contact on a top of the connector receptacle (as it is inserted into the connector receptacle 112), or it may be a side ground contact on a side of the connector insert.

When USB 2.0 or lightning signals are received on contacts 1620 they may be received on contacts 1610 as well. This may be done to support the use of lightning connectors, in which the contacts in a top row contacts in a connector insert are electrically connected to contacts in a bottom row of contacts in the connector insert in one of at least two patterns. Accordingly, the USB 2.0 or lightning signals may be connected to switches 1630. In this state, switches 1630 may be open, thereby preventing the signals from reaching USB controller 1640. This may be of particular importance where switches 1630 may be relatively close to connector receptacle 112, while USB controller 1640 may be remote. By shortening the traces connected to contacts 1610, the effects of the transmission line stubs that are otherwise formed by the traces to the switches 1630 may be minimized. USB 2.0 signals on contacts 1620 may be provided to multiplexing circuit 1650. Multiplexing circuit 1650 may provide the USB 2.0 or lightning signals on output lines 1652 to core logic 1660 or other circuitry.

Connector receptacle 112 may be able to connect to and power either USB 2.0 or USB 3.0 accessories. Accordingly, a power circuitry 1670 may be included such that power may be provided to USB 2.0 accessories. When power for a USB 3.0 accessory is needed, second power source 1680 may replace or be added to the first power source 1670. In these and other embodiments of the present invention, power may be received by connector receptacle 112. In these and other embodiments of the present invention, power may be received at a first contact and power may be provided by a second contact of connector receptacle 112 at the same time.

Connector receptacle 112 may have a form factor that is physically compatible with a lightning connector. That is, a lightning connector may be inserted into connector receptacle 112 and used to deliver lightning signals, which include USB 2.0 signals, to the illustrated circuitry. Since lightning includes at least two types of connector inserts which may be inserted into connector receptacle 112, connector receptacle 112 may be able to accept two types of lightning connector inserts. Connector receptacle 112 may also be able to accept a type of USB 3.0 connector. This USB 3.0 connector may be non-standard. A dongle or adapter may be provided to adapt a USB 3.0 form factor to one compatible with connector receptacle 112. Accordingly, in various embodiments of the present invention, connector receptacle 112 may be able to accept at least three types of connector inserts, including two lightning connector inserts and a USB 3.0 connector insert, which may be part of a dongle adapter. In other embodiments of the present invention, instead of a dongle, an accessory may include a cable adapter or have a connection that may mate with connector receptacle 112.

In various embodiments of the present invention, a connector insert that may mate with connector receptacle 112 may be rotatable. That is, the connector insert, such as connector insert 132, may be plugged into connector receptacle 112 in either of two orientations that are 180 degrees rotated relative to each other. When combined with the above three types of connector inserts that may be inserted into connector receptacle 112, there are at least six configurations of inputs that may be received by connector receptacle 112. These are shown in the following figures.

Figure 17:
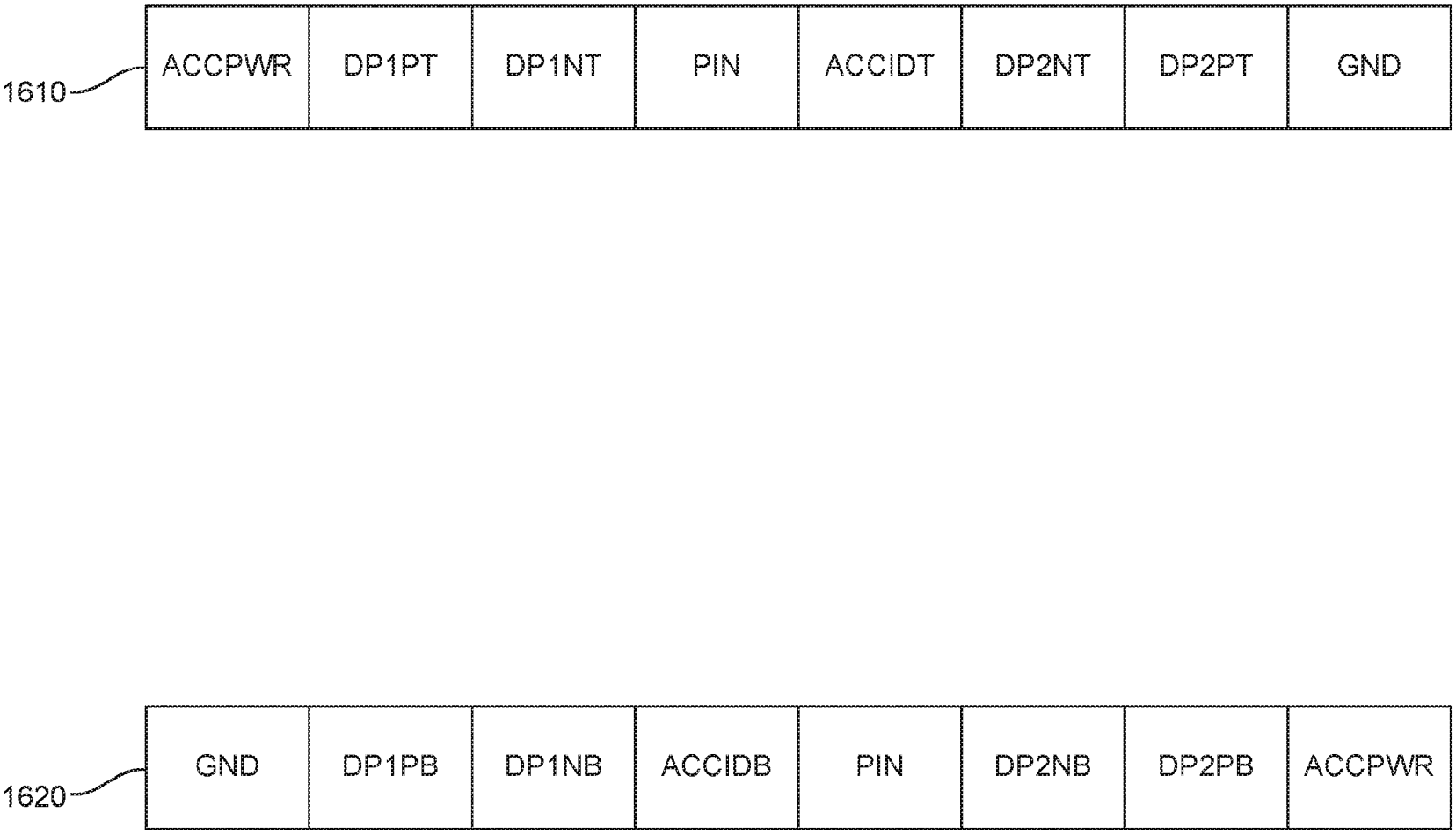
FIG. 17 illustrates the names of contacts that may be used for a receptacle according to an embodiment of the present invention.

FIG. 17 illustrates the names of contacts that may be used for a receptacle according to an embodiment of the present invention. These names may be used for connector receptacle 112 or other connector according to embodiments of the present invention. A top row of contacts 1610 may begin with an accessory interface contact ACCPWR. In various embodiments of the present invention, this contact may actually be a no-connect in connector receptacle 112. The following contacts may be the positive and negative terminals of a high-speed USB 3.0 signal pair, DP1PT and DP1NT. A power contact, PIN, over which power may be received from an accessory, and a second accessory contact, ACCIDT, may follow. High-speed USB 3.0 contacts DP2NT and DP2PT may be next, followed by a ground contact (GND).

A bottom row of contacts 1620 may begin with ground, which may be followed by the positive and negative terminals, DP1PB and DP1NB, of a USB 2.0 signal. A first accessory contact ACCIDB may be next, followed by a contact for receiving power from accessory, PIN. Terminals of a UART signal pair, DP2NB and DP2PB, may be next, and the row may end with a second accessory contact ACCPWR.

Again, in various embodiment of the present invention, signals for a USB 3.0 interface may be provided on a connector insert that is inserted into connector receptacle 112. Since connector receptacle 112 may be arranged to accept connector inserts with a lightning connector form factor, embodiments of the present invention may provide a dongle to adapt a USB 3.0 connector to a connector having a lightning connector form factor. An example of such a dongle is shown in the following figures.

Figure 18:
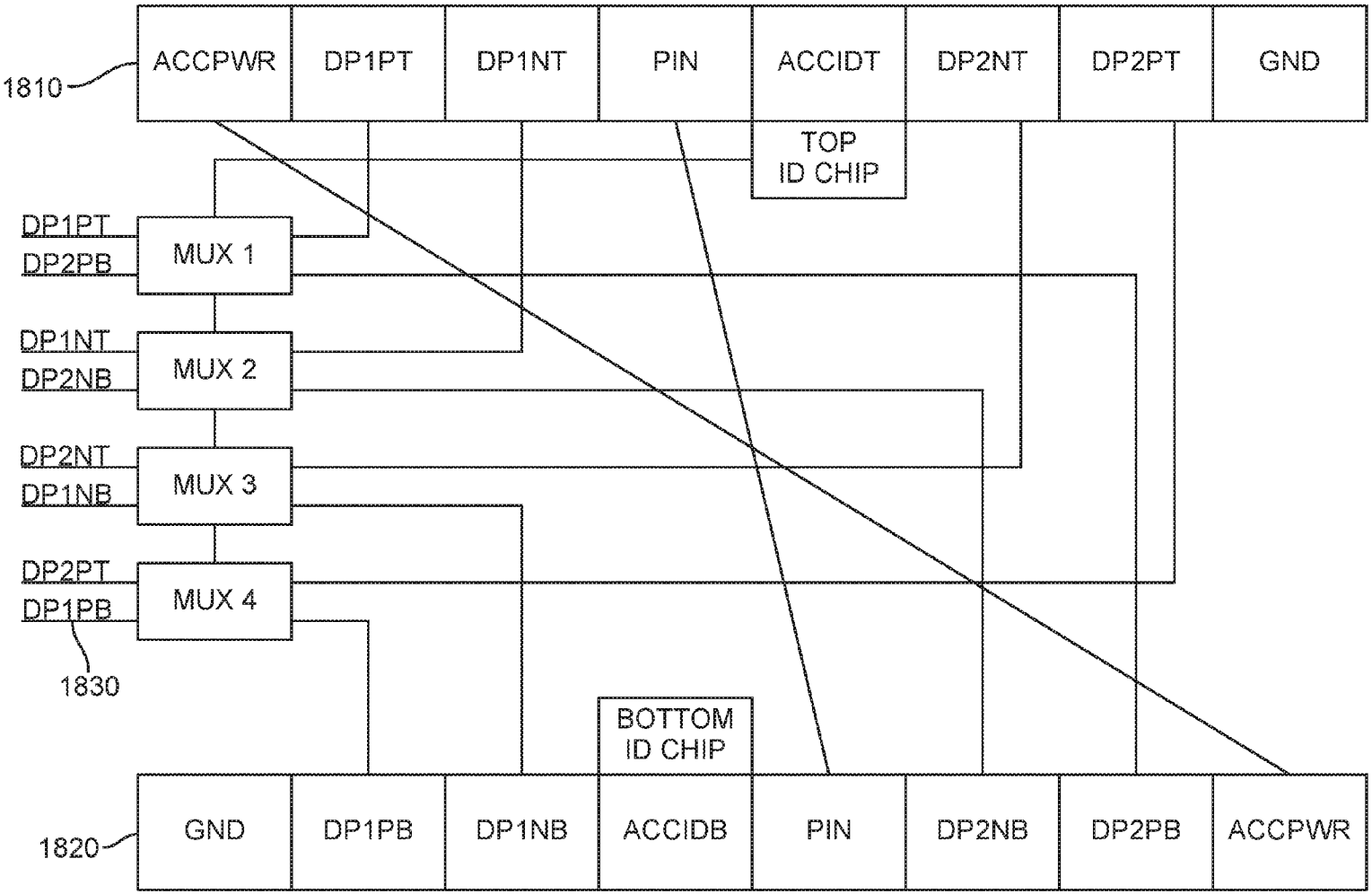
FIG. 18 illustrates circuitry for a dongle that may provide signals of a USB 3.0 interface onto a connector insert having a lightning connector insert form factor according to an embodiment of the present invention.

FIG. 18 illustrates circuitry for a dongle that may provide signals of a USB 3.0 interface onto a connector insert having a lightning connector insert form factor according to an embodiment of the present invention. In this example, the dongle may have a first port 1830 for pathways for high-speed USB 3.0 signals, as well as a USB 2.0 signal pair and a UART signal pair. First port 1830 may be a USB 3.0 type connector. These signals may couple through multiplexers to one of two contacts of the connector insert, where the connector insert has the form factor of a lightning connector. The connector insert may include a top row of contacts 1810 and a bottom row of contacts 1820.

The top row of contacts 1810 may include may begin with an accessory interface contact ACCPWR. The following contacts may be the positive and negative terminals of a high-speed USB 3.0 contact pair, DP1PT and DP1NT. A power contact, PIN, over which power may be received from an accessory, and a second accessory contact, ACCIDT, may follow. High-speed USB 3.0 contacts DP2NT and DP2PT may be next, followed by a ground contact.

A bottom row of contacts 1620 may begin with ground, which may be followed by the positive and negative terminals, DP1PB and DP1NB, for a USB 2.0 signal. A first accessory contact ACCIDB may be next, followed by a contact for receiving power from accessory, PIN. Terminals of a UART signal pair, DP2NB and DP2PB, may be next, and the row may end with a second accessory contact ACCPWR.

Again, this connector insert may be inserted into connector receptacle 112 as shown in FIG. 17 in either of two orientations that are separated by 180 degrees. Accordingly, each signal at port 1830 may be multiplexed to one of two contacts that are located 180 degrees apart on the connector insert. For example, signal DP1PT of port 1830 received by MUX 1 may be connected to contact DP1PT in the top row of contacts 1810 when MUX 1 is in a pass-through mode, or signal DP1PT may be connected to contact DP2PB in the bottom row of contacts 1820 when MUX 1 is in a cross mode. Similarly, signal DP2PB may be connected to contact DP1PT in the top row of contacts 1810 when MUX 1 is in the cross mode, or signal DP2PB may be connected to contact DP2PB in the bottom row of contacts 1820 when MUX 1 is in the pass-through mode. The same operation may be true for MUX 2, MUX 3, and MUX 4, and their respective signals.

In various embodiments of the present invention, signals DP2PB and DP2NB may not be USB 3.0 signals, but may instead be UART signals that are used to convey authentication information from an accessory or other dongle circuitry that is not shown here.

The multiplexers MUX 1, MUX 2, MUX 3, and MUX 4 may be under control of a top ID chip, where the top ID chip is connected to contact ACCIDT. Specifically, when this connector insert is inserted into connector receptacle 112 in a non-rotated position, the top ID chip is disconnected. The top ID chip may detect this disconnection and set multiplexers MUX 1, MUX 2, MUX 3, and MUX 4 into the pass-through mode. In this configuration, the bottom ID chip, which is connected to contact ACCIDB, may communicate with circuitry associated with the multiplexer 1650, as shown in FIG. 16. The bottom ID chip may inform circuitry associated with multiplexer 1650 that a USB 3.0 connector insert has been inserted into connector receptacle 112. From the fact that a USB 3.0 connector has been inserted, circuitry associated with multiplexers 1650 may determine that no multiplexing of the received signals is needed. An example is shown in the following figure.

Figure 19:
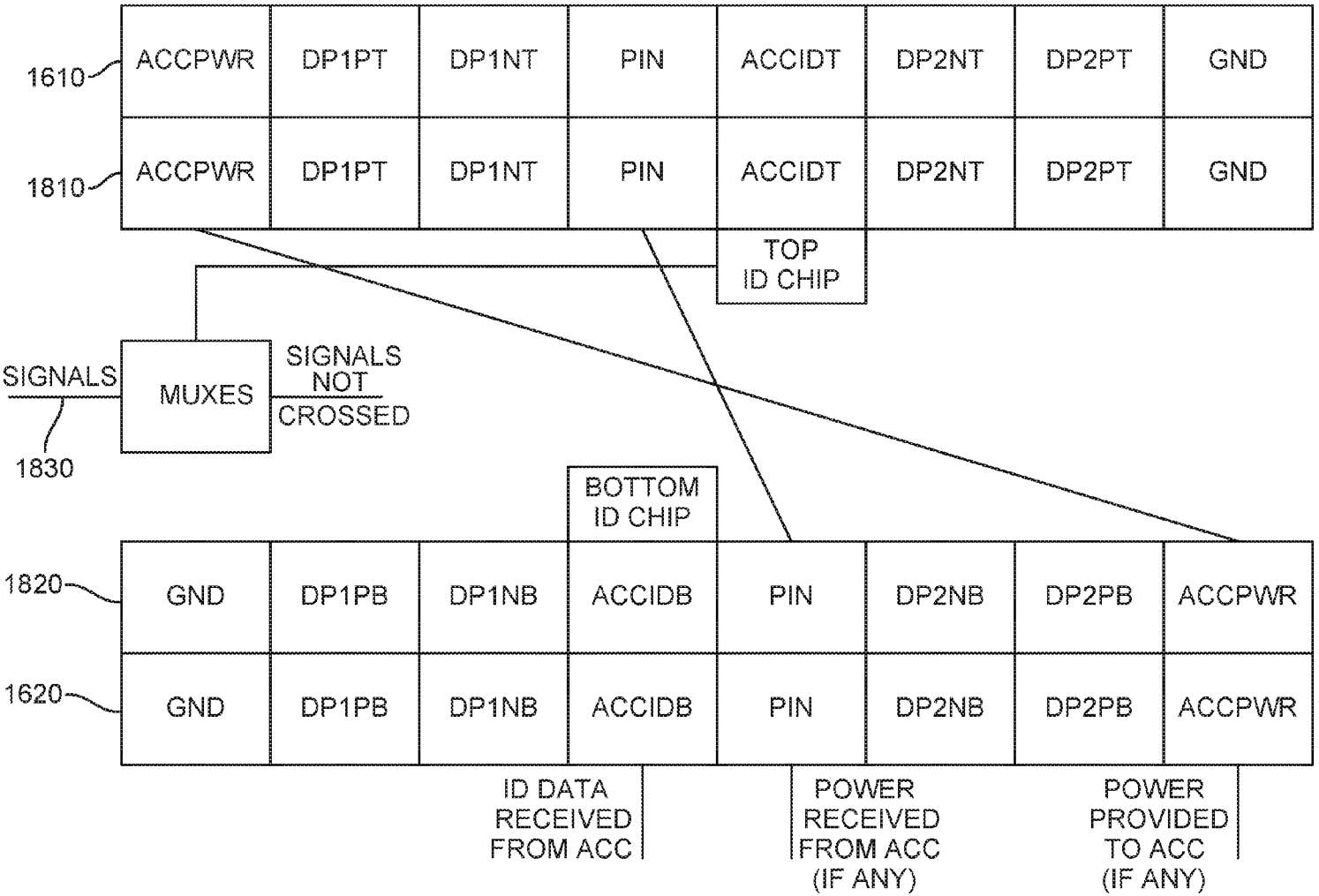
FIG. 19 illustrates the dongle of FIG. 18 inserted into a connector receptacle in a non-rotated position according to an embodiment of the present invention.

FIG. 19 illustrates the dongle of FIG. 18 inserted into a connector receptacle in a non-rotated position according to an embodiment of the present invention. Again, in this configuration, the top ID chip may be disconnected. Due to this disconnection, the top ID chip may instruct the dongle multiplexers to not cross the data signals, but instead to pass them in the pass-through mode. A bottom ID chip may be connected to multiplexers 1650 in FIG. 16. Circuitry associated with multiplexers 1650 in FIG. 16 may receive identification data from the dongle or accessory via the ACCIDB contact. In this configuration, power may either be provided to the dongle or accessory, or power may be received from the dongle or accessory. Specifically, power may be provided to the dongle or accessory via the ACCPWR contacts, which may be connected together inside the connector insert. Alternatively, power may be received from the dongle or accessory via the PIN contacts, which may be connected to each other in the connector insert.

When this connector inserts is inserted into connector receptacle 112 in a rotated position, the bottom ID chip may be disconnected. The top ID chip may communicate with circuitry associated with multiplexers 1650, as shown in FIG. 16. The top ID chip may then instruct multiplexers MUX 1, MUX 2, MUX 3, and MUX 4 to enter the cross mode. An example is shown in the following figure.

Figure 20:
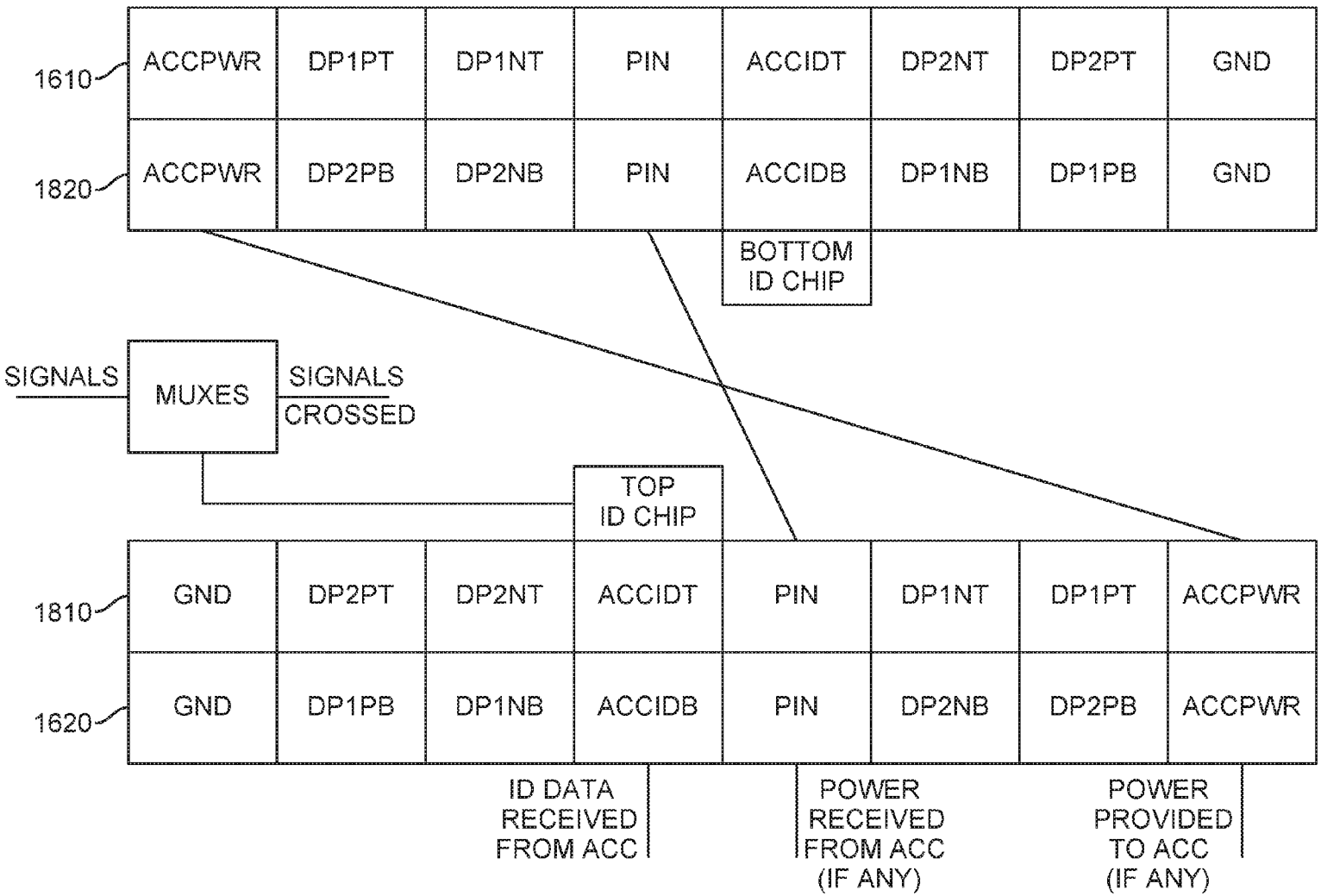
FIG. 20 illustrates the dongle of FIG. 18 inserted into a connector receptacle in a rotated position according to an embodiment of the present invention.

FIG. 20 illustrates the USB 3.0 dongle of FIG. 18 inserted into a connector receptacle in a rotated position according to an embodiment of the present invention. In this configuration, the top ID chip may be connected to multiplexers 1650, as shown in FIG. 16. Due to this connection, it may instruct the dongle multiplexers to cross the data signals, that is it may instruct the multiplexers in the dongle to operate in the cross mode. The bottom ID chip may be disconnected. Circuitry associated with multiplexers 1650 in FIG. 16 may receive identification information from the dongle or accessory via the ACCIDB contact from the top ID chip. In this configuration, power may either be provided to the dongle or accessory, or power may be received from the dongle or accessory. Specifically, power may be provided to the dongle or accessory via the ACCPWR contacts, which may be connected together inside the connector insert. Alternatively, power may be received from the dongle or accessory via the PIN contacts, which may be connected to each other in the connector insert.

The multiplexers MUX 1, MUX 2, MUX 3, and MUX 4, the ID chip, and an authentication chip, which may be combined on one or more chips, may be located in the dongle, the accessory, or a combination thereof. The ID chip may identify the dongle or the accessory, or both. The authentication chip may authenticate the dongle or the accessory, or both.

Again, in various embodiment of the present invention, connector receptacle 112 in FIG. 16 may be able to accept lightning connector inserts. An example of one such insert is shown in the following figure.

Figure 21:
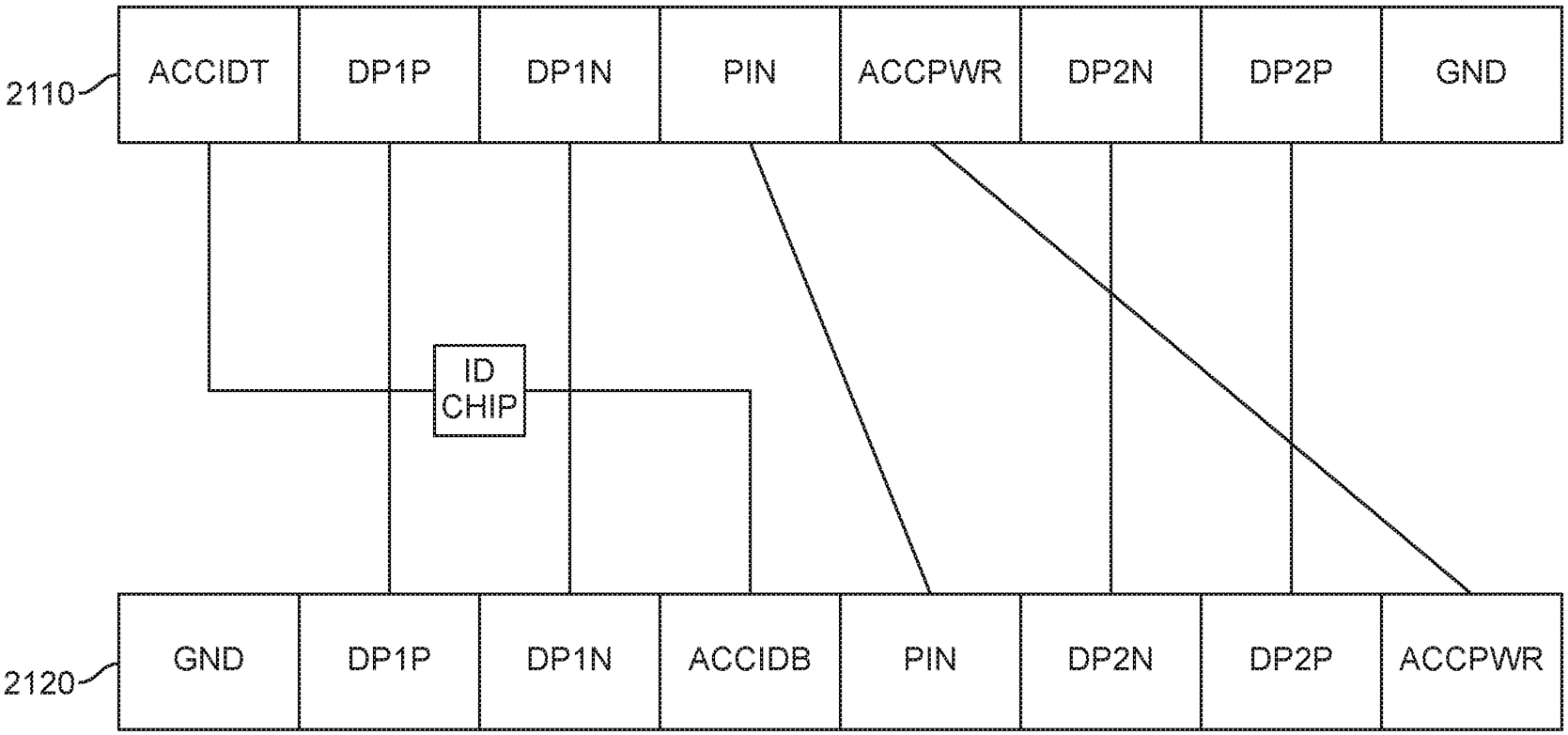
FIG. 21 illustrates a lightning connector insert that may be inserted into a connector receptacle according to an embodiment of the present invention.

FIG. 21 illustrates a lightning connector insert that may be inserted into a connector receptacle according to an embodiment of the present invention. This connector insert may include a top row of contacts 2110 and a bottom row of contacts 2120. The top row of contacts 2110 may include and accessory identification contact ACCIDT, which may be connected to an identification chip. This contact may be followed by contacts for a USB differential pair DP1P and DP1N. The top row of contacts may next include a contact PIN, which may be used to receive power from an accessory, and a contact ACCPWR, which may be used to provide power to accessory. Contacts for a UART signal, DP2N and DP2P, maybe next, followed by a ground contact.

The bottom row of contacts 2120 may include a ground contact, followed by the USB signal pins, which may be connected in a connector insert to corresponding USB signal pins in the top row of contacts 2120. An accessory identification contact ACCIDB may also contact the ID chip. The contact PIN, which may be used to receive power from accessory, may follow. UART signal contacts, which may be connected in a connector insert to UART contacts DP2N and DP2P in the top row of contacts 2110 may be next, followed by an accessory power contact ACCPWR which may be used to provide power to an accessory.

Again, this connector insert may be inserted in to the connector receptacle 112 of FIG. 16 in either a rotated or a non-rotated position. Examples are shown in the following figures.

Figure 22:
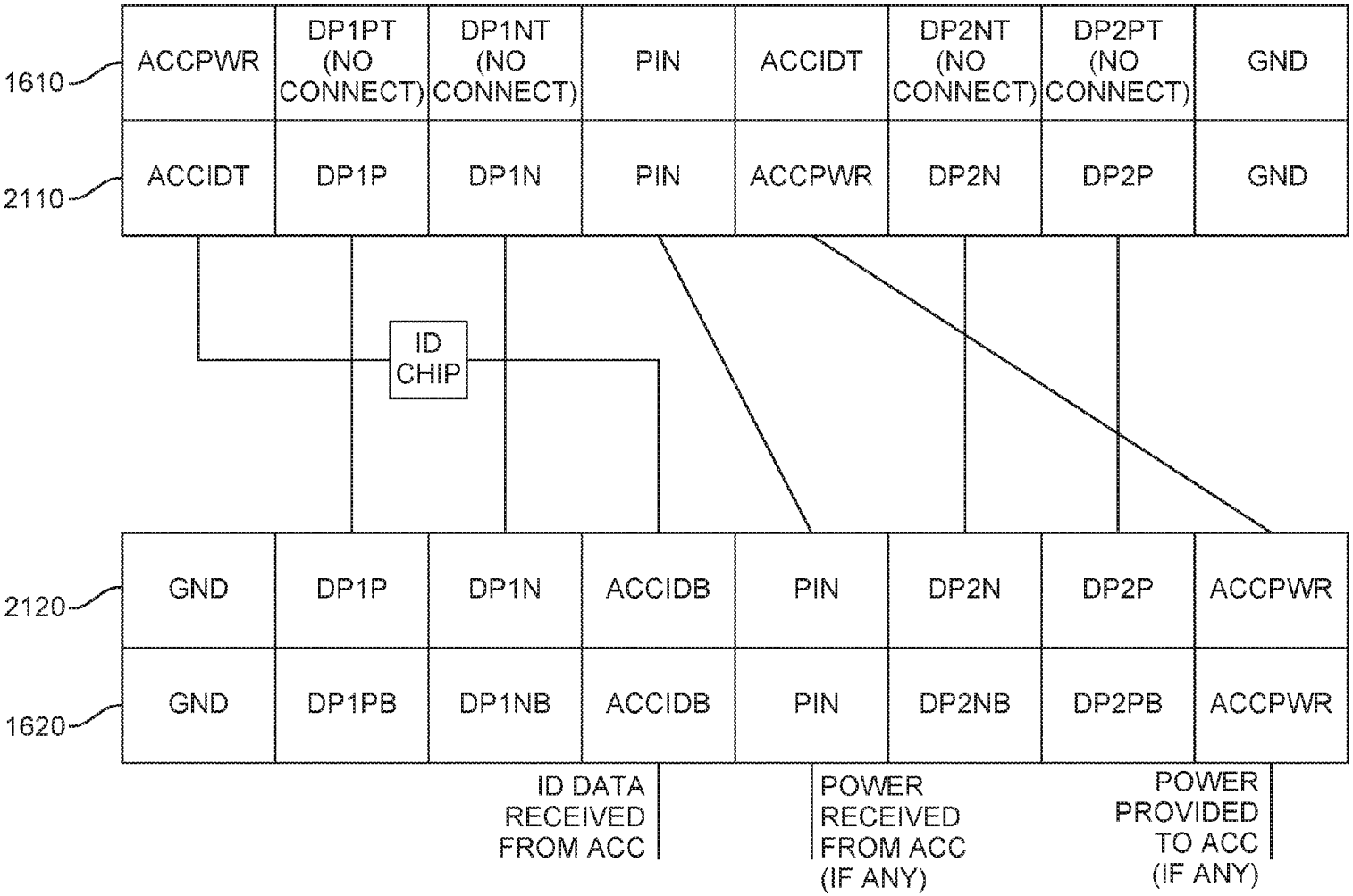
FIG. 22 illustrates the connector insert of FIG. 21 inserted into a connector receptacle in a non-rotated position according to an embodiment of the present invention.

FIG. 22 illustrates the connector insert of FIG. 21 inserted into a connector receptacle in a non-rotated position according to an embodiment of the present invention. When a connection is detected, ID data may be received from an accessory via the accessory contact ACCIDB. As before, power may be provided to the accessory via the ACCPWR contacts, which may be connected together inside the connector insert. Alternatively, power may be received from the accessory via the PIN contacts, which may be connected to each other inside the connector insert.

Figure 23:
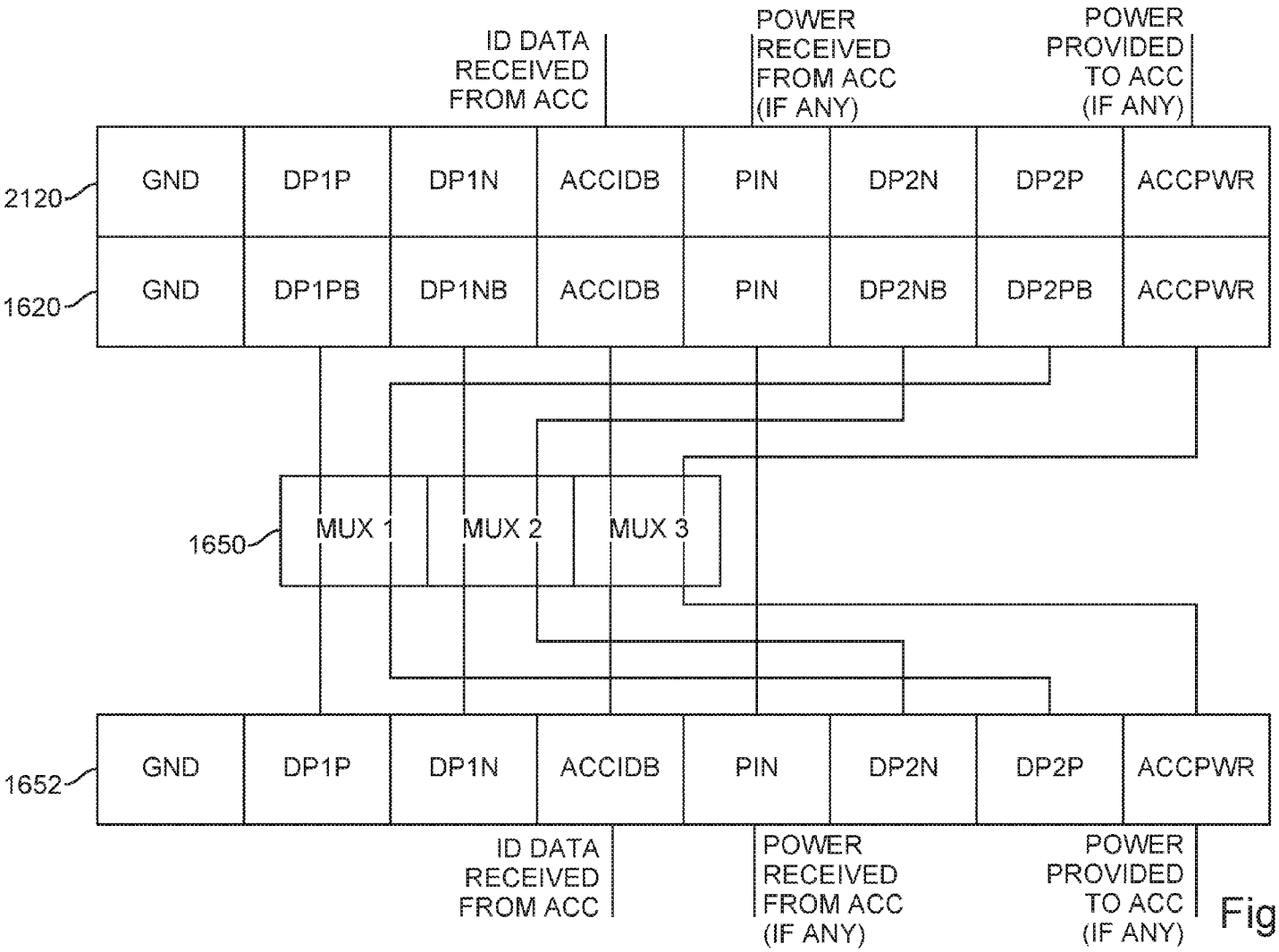
FIG. 23 illustrates the operation of multiplexers in a connector receptacle circuit according to an embodiment of the present invention.

FIG. 23 illustrates the operation of multiplexers in a connector receptacle circuit according to an embodiment of the present invention. As shown, three multiplexers, MUX 1, MUX 2, and MUX 3 (collectively multiplexers 1650), may be used to reorder signals on the bottom row 1620 of contacts in connector receptacle 112. When the connector insert is not rotated, as in FIG. 22 above, the multiplexers MUX 1, MUX 2, and MUX 3 may each be placed in a pass-through mode and the outputs 1652 are not reordered. In this way, the multiplexers 1650 do not reorder the signals on contacts 1620 when they are provided by a non-rotated connector insert, as shown in FIG. 22.

Figure 24:
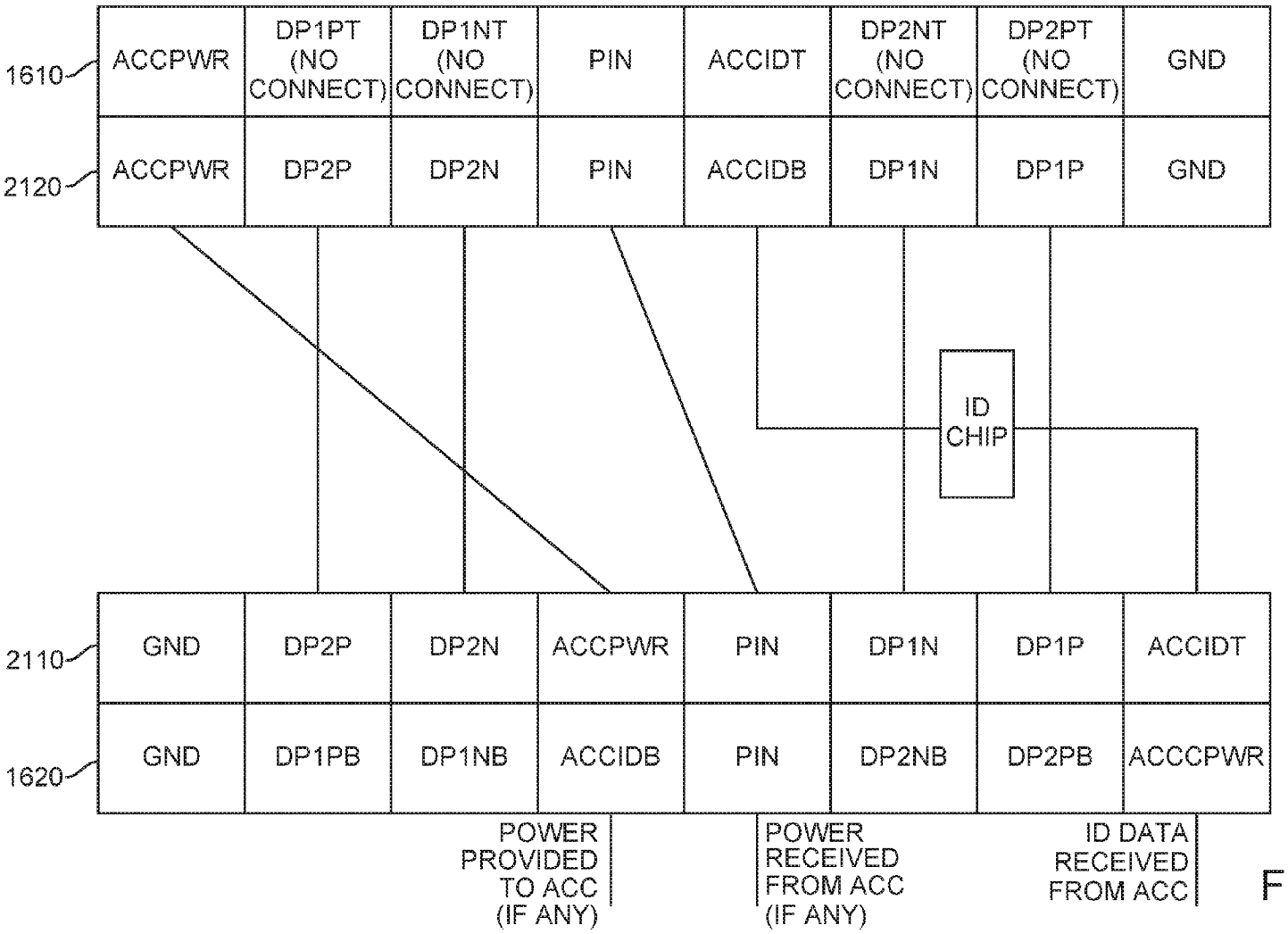
FIG. 24 illustrates the connector insert of FIG. 21 inserted into a connector receptacle in a rotated position according to an embodiment of the present invention.

FIG. 24 illustrates the connector insert of FIG. 21 inserted into a connector receptacle in a rotated position according to an embodiment of the present invention. When a connection is detected, circuitry associated with the multiplexers 1650 in FIG. 16 may attempt to read accessory identification information on contact ACCIDB. However, with the reversed connection, ACCIDB may be a power connection. After failing to read accessory identification information on the ACCIDB contact, circuitry associated with multiplexers 1650 may attempt to read identification information on the ACCPWR contact. Once the ID data is read, multiplexers 1650 may determine that the connector insert is inserted in a rotated orientation. From this, multiplexers 1650 may determine a configuration that is needed to correct for the rotation of the connector insert.

More specifically, in FIG. 22, a bottom row of contacts 2120 in the connector insert provides signals to corresponding contacts in a bottom row of contacts 1620 of a connector receptacle 112. The order of these signals is different than in FIG. 24, where the top row of contacts 2120 on the connector insert provides signals to contacts 1620 in the connector receptacle 112. Accordingly, multiplexers 1650, as shown in FIG. 16, may rearrange the signals as provided in FIG. 24 to match the signals as provided in FIG. 22. In this way, signals may be received by core circuitry 1660 in the same order whichever way the lightning connector insert is inserted into connector receptacle 112. An example of the operation of multiplexers 1650 of FIG. 16 is shown in the following figure.

Figure 25:
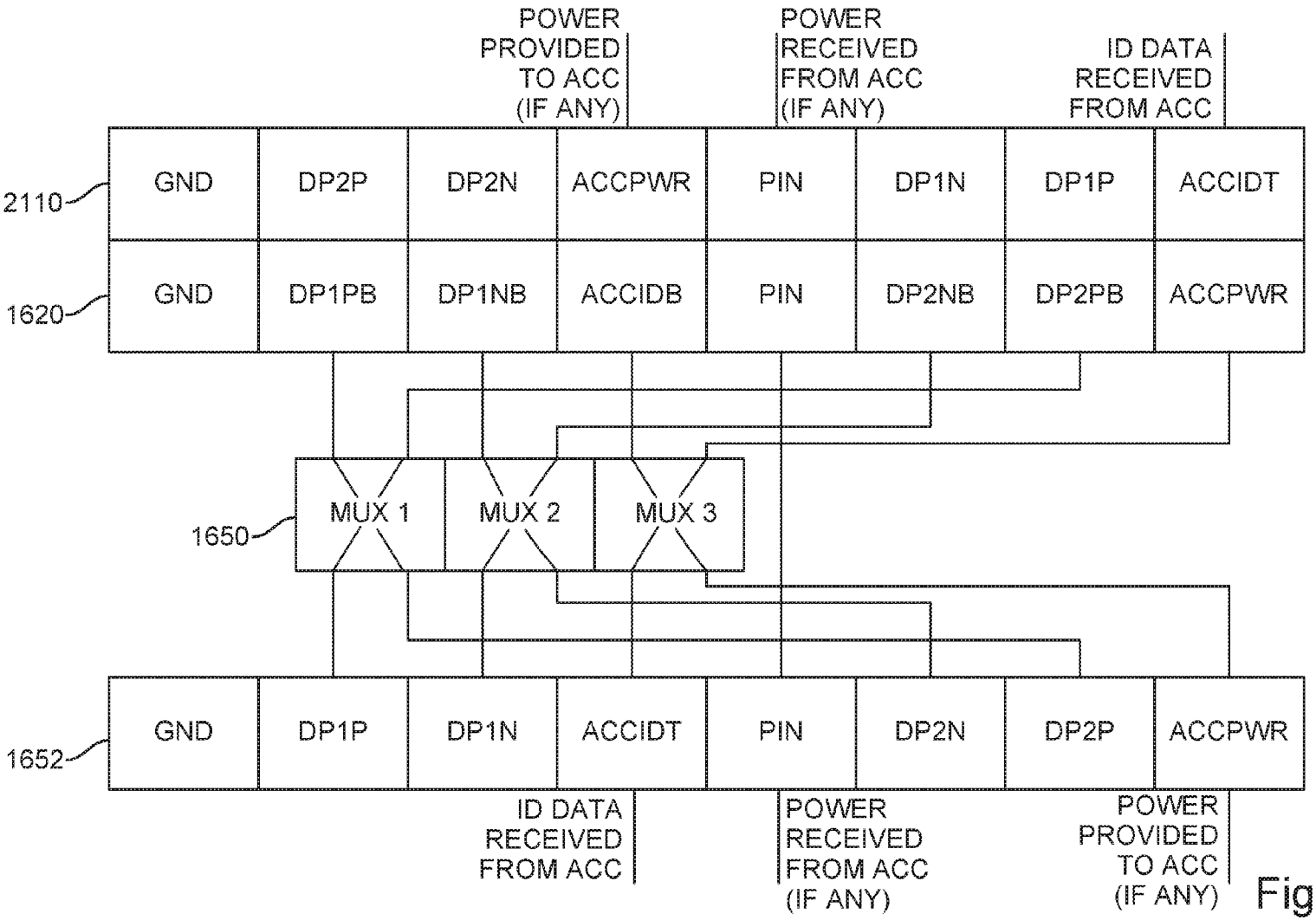
FIG. 25 illustrates the operation of multiplexers in a connector receptacle circuit according to an embodiment of the present invention.

FIG. 25 illustrates the operation of multiplexers in a connector receptacle circuit according to an embodiment of the present invention. As shown, three multiplexers, MUX 1, MUX 2, and MUX 3 (collectively multiplexers 1650), may be used to reorder signals on the bottom row 1620 of contacts in connector receptacle 112. When signals are provided by a rotated connector insert as shown in FIG. 24, the multiplexers MUX 1, MUX 2, and MUX 3 may each be placed in a cross mode as shown to reorder these signals and provide outputs 1652 at the output of multiplexers 1650. Again, when the connector insert is not rotated, as in FIG. 22, the multiplexers 1650 may each be placed in a pass-through mode and the outputs 1652 are not reordered. In this figure, multiplexers 1650 may reorder the signals on contacts 1620 when the connector insert is rotated, as shown in FIG. 24, to match the signals as they are provided by a non-rotated connector insert, as shown in FIG. 22.

Again, embodiments of the present invention may be able to accept a second type of lightning connector insert. This type of connector insert may be referred to as a symmetrical connector insert. In this configuration, signal pins may remain in the same positions whether a connector insert is inserted in a rotated or a non-rotated position. An example of such a connector insert is shown in the following figure.

Figure 26:
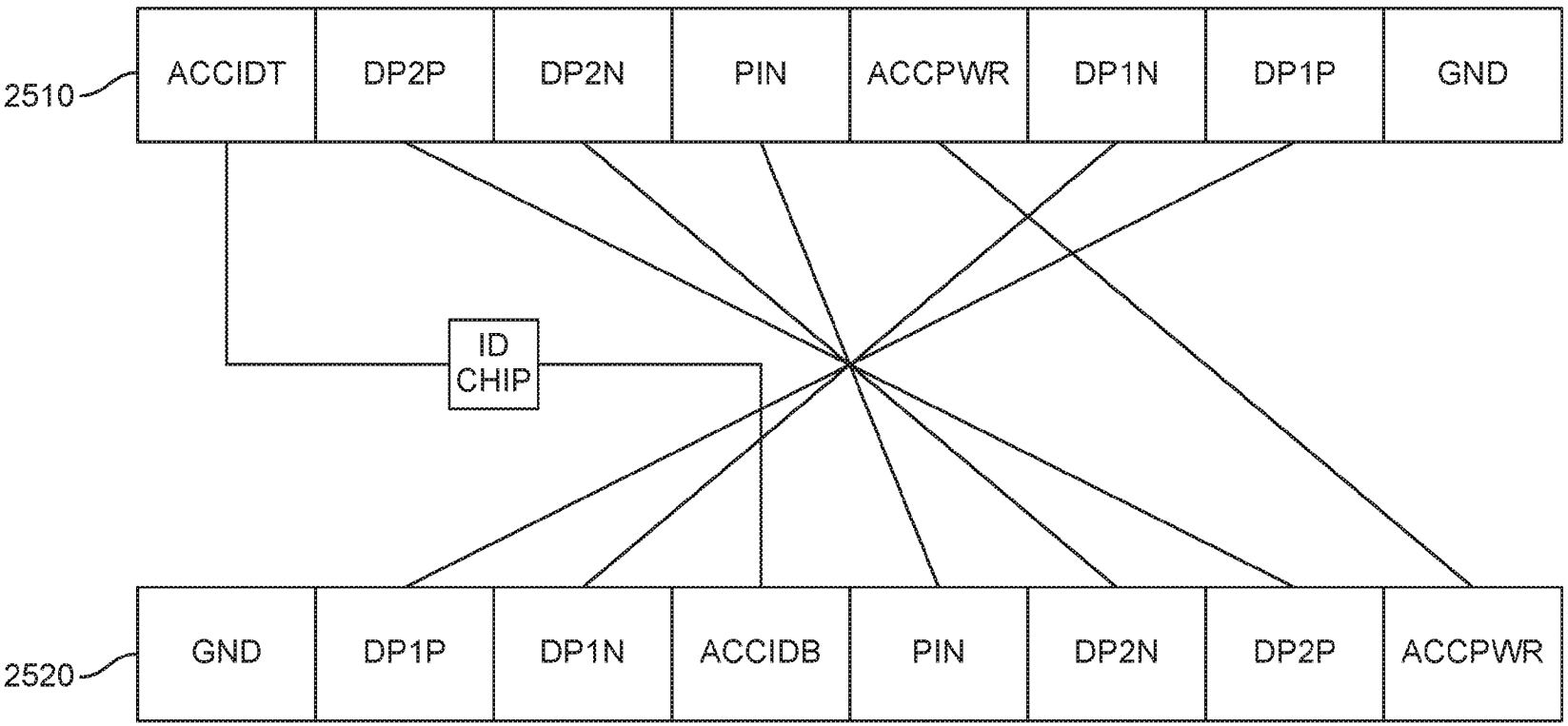
FIG. 26 illustrates another lightning connector insert that may be inserted into a connector receptacle according to embodiments of the present invention.

FIG. 26 illustrates another lightning connector insert that may be inserted into a connector receptacle according to embodiments of the present invention. This connector insert may include a top row of contacts 2510 and a bottom row of contacts 2520. The top row of contacts 2110 may include an accessory identification contact ACCIDT, which may be connected to an identification chip. This contact may be followed by contacts for a USB differential pair DP1P and DP1N. The top row of contacts may next include a contact PIN, which may be used to receive power from an accessory, and a contact ACCPWR, which may be used to provide power to accessory. Contacts for a UART signal, DP2N and DP2P, maybe next, followed by a ground contact. The data contacts DP1P and DP1N, as well as DP2N and DP2P, may be connected in the connector insert to symmetrically placed contacts on a bottom row of contacts 2520. The ACCPWR and PIN contacts may also be connected. An ACCIDB contact in the bottom row of contacts 2520 may also be connected to the ID chip.

As with the other connector inserts, this connector insert may be inserted into connector receptacle 112 in a non-rotated position or a rotated position. Examples of this are shown in the following figures.

Figure 27:
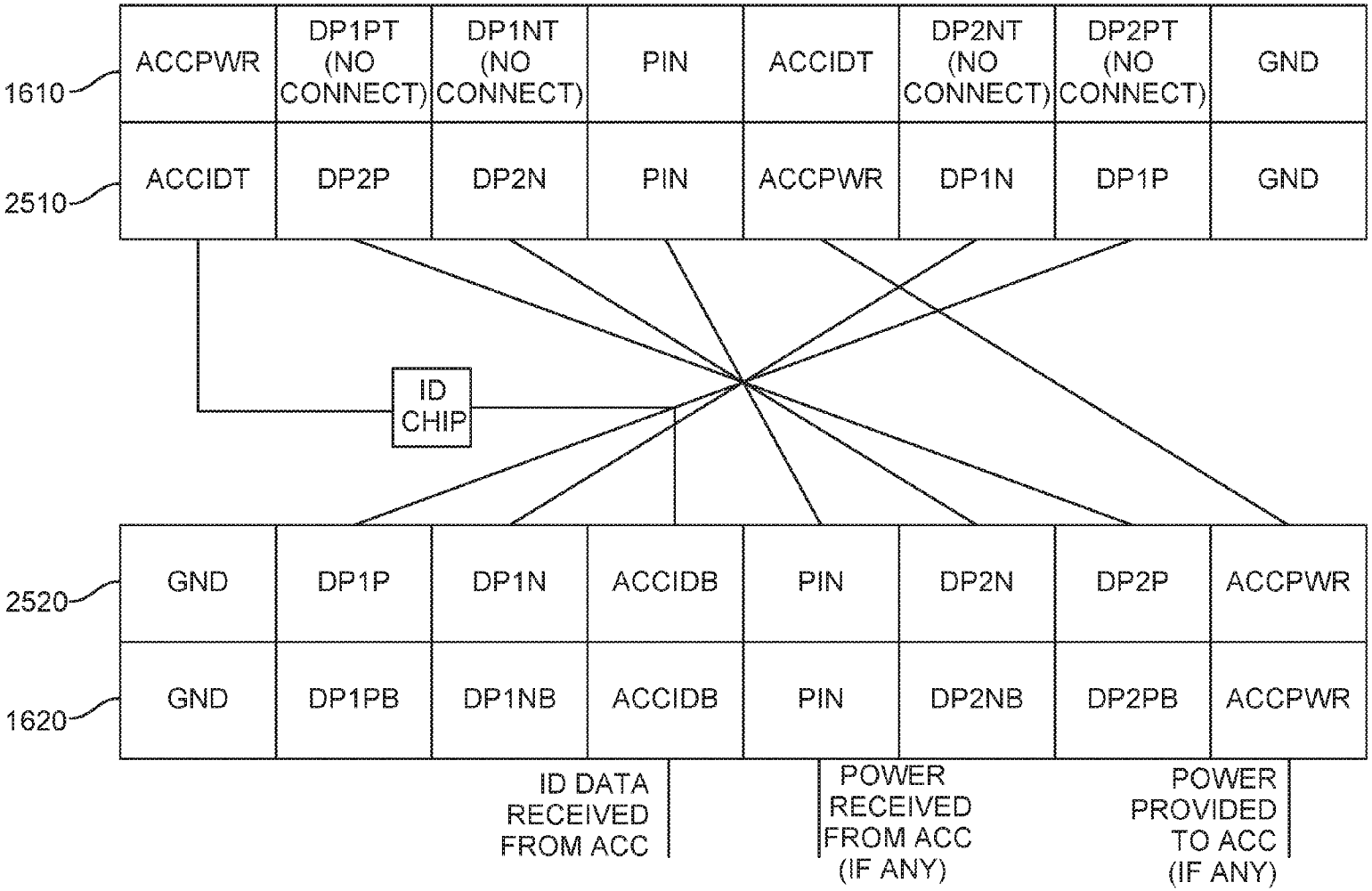
FIG. 27 illustrates the connector insert of FIG. 26 inserted into a connector receptacle in a non-rotated position according to an embodiment of the present invention.

FIG. 27 illustrates the connector insert of FIG. 26 inserted into a connector receptacle in a non-rotated position according to an embodiment of the present invention. When a connection is detected, ID data may be received from the ID chip via the accessory contact ACCIDB. As before, power may be provided to the accessory via the ACCPWR contacts, which may be connected inside the connector insert. Alternatively, power may be received from the accessory via the PIN contacts, which may be connected to each other inside the connector insert.

Figure 28:
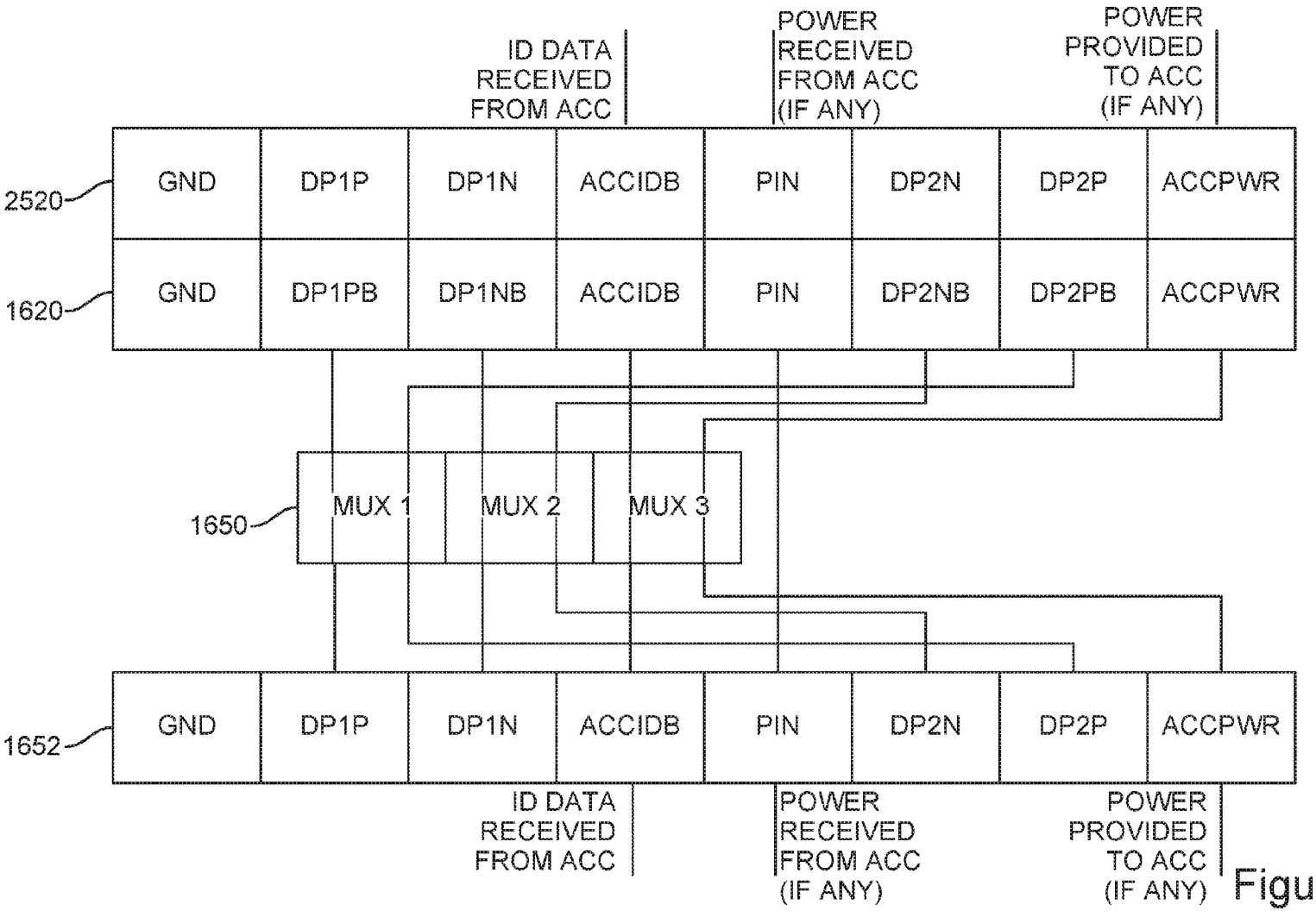
FIG. 28 illustrates the operation of multiplexers in a connector receptacle circuit according to an embodiment of the present invention.

FIG. 28 illustrates the operation of multiplexers in a lightning signal path according to an embodiment of the present invention. As shown, three multiplexers, MUX 1, MUX 2, and MUX 3 (collectively multiplexers 1650), may be used to either pass through or reorder signals on the bottom row 1620 of contacts in connector receptacle 112 and provide them as outputs 1652. When the connector insert is not rotated, as in FIG. 27, the multiplexers 1650 (MUX 1, MUX 2, and MUX 3) may each be placed in a pass-through mode and the outputs 2410 are not reordered.

Figure 29:
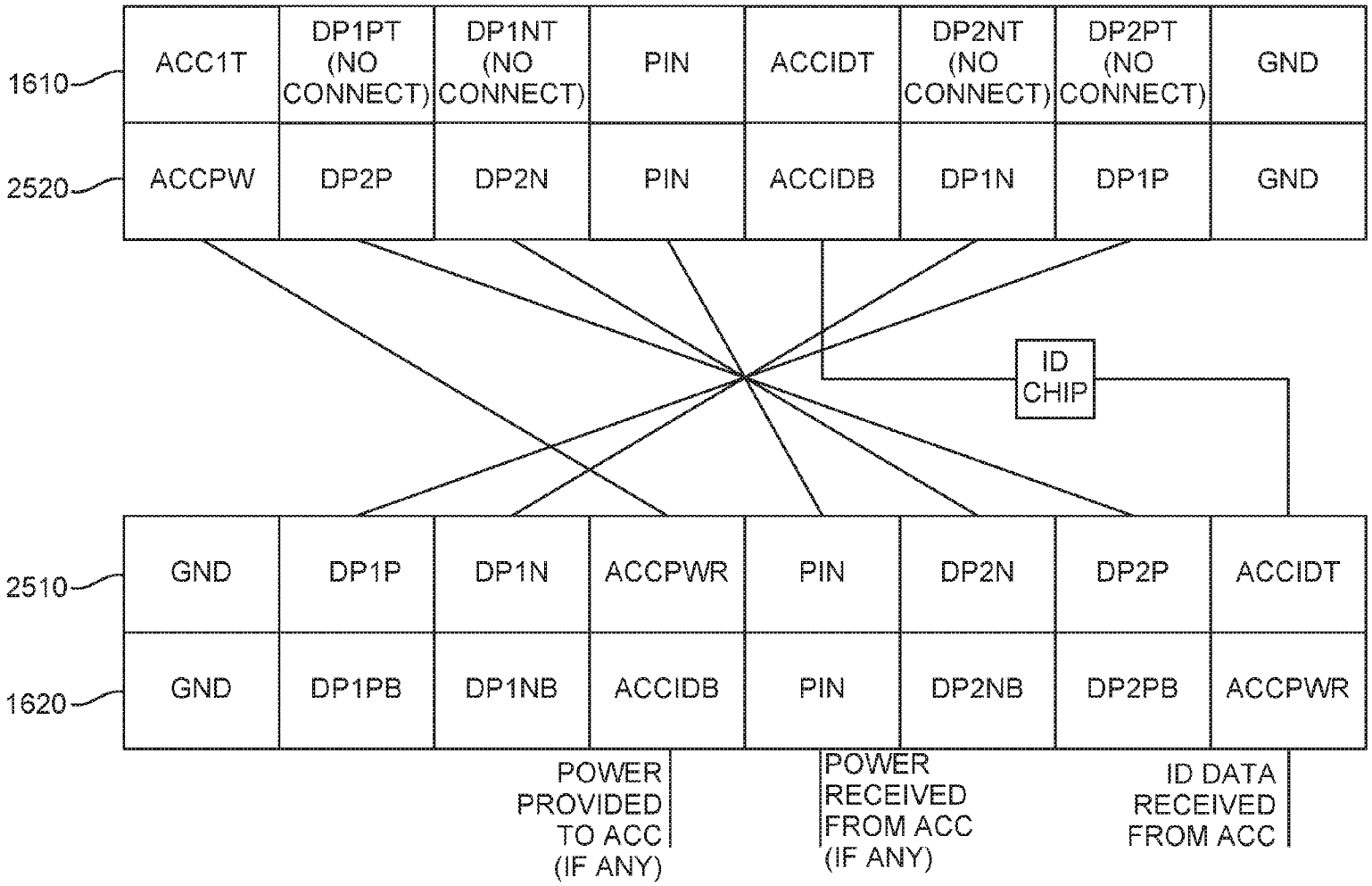
FIG. 29 illustrates the connector insert of FIG. 26 inserted into a connector receptacle in a rotated position according to an embodiment of the present invention.

FIG. 29 illustrates the connector insert of FIG. 26 inserted into a connector receptacle in a rotated position according to an embodiment of the present invention. When a connection is detected, circuitry associated with multiplexers 1650 in FIG. 16 may attempt to read accessory identification information on contact ACCIDB. However, with the reversed connection, ACCIDB may be a power connection. After failing to read accessory identification information on the ACCIDB contact, circuitry associated with multiplexers 1650 may attempt to read identification information on the ACCPWR contact. Once the ID data is read, circuitry associated with multiplexers 1650 may determine that the connector insert is inserted in a rotated orientation. From this, circuitry associated with multiplexers 1650 may determine a configuration that is needed to correct for the rotation of the connector insert.

More specifically, in FIG. 27, a bottom row of contacts 2520 in the connector insert may provide signals to corresponding contacts in a bottom row of contacts 1620 of a connector receptacle 112. The order of these signals is different than in FIG. 29, where the top row of contacts 2520 on the connector insert may provide signals to contacts 1620 in the connector receptacle 112. Accordingly, multiplexers 1650, as shown in FIG. 16, may rearrange the signals as provided in FIG. 29 to match the signals as provided in FIG. 27. In this way, signals may be received by core circuitry 1660 in the same order whichever way the lightning connector insert is inserted into connector receptacle 112. An example of the operation of multiplexers 1650 of FIG. 16 is shown in the following figure.

Figure 30:
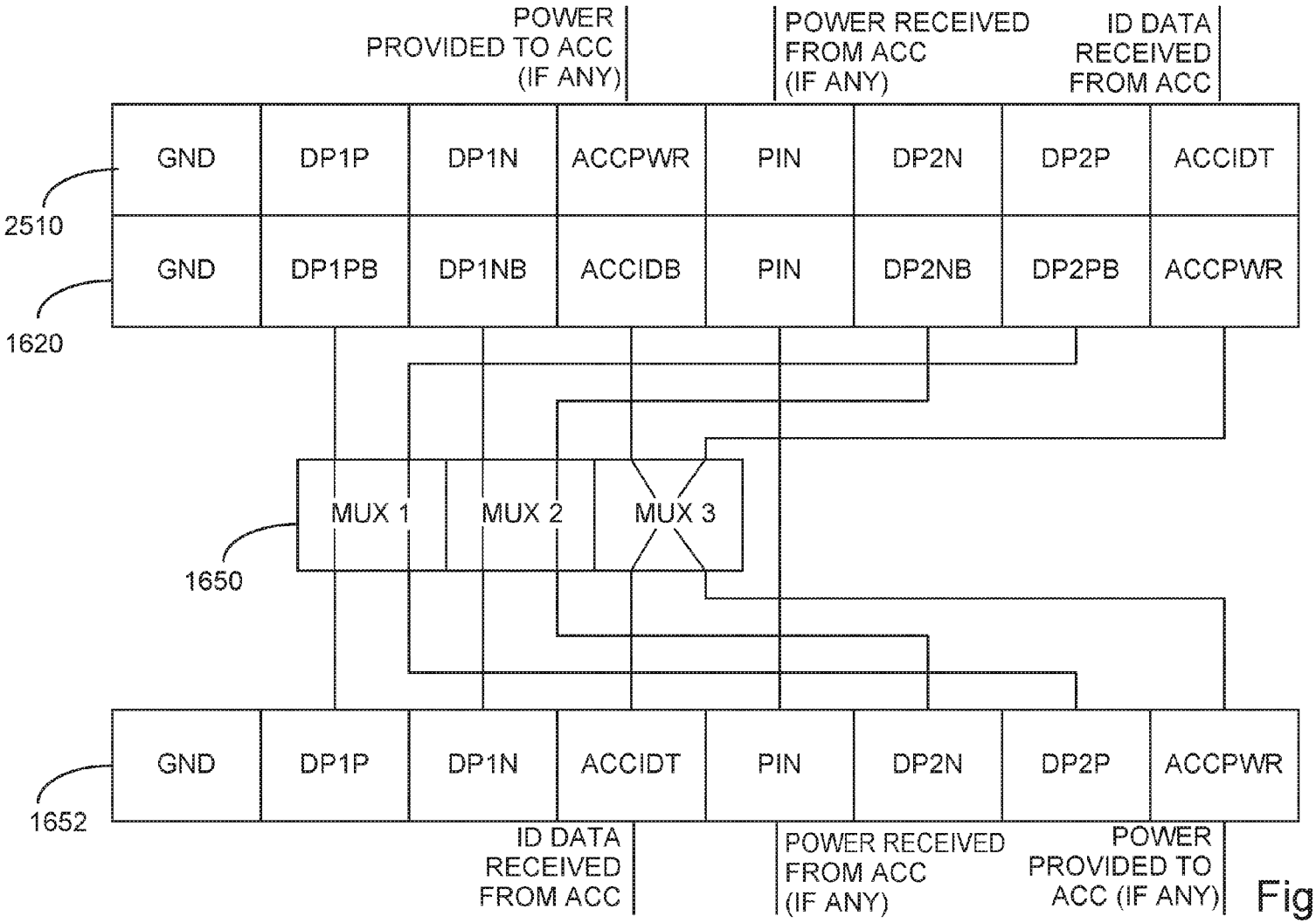
FIG. 30 illustrates the operation of multiplexers in a connector receptacle circuit according to an embodiment of the present invention.

FIG. 30 illustrates the operation of multiplexers in a lightning signal path according to an embodiment of the present invention. As shown, three multiplexers, MUX 1, MUX 2, and MUX 3 (collectively multiplexers 1650), may be used to reorder signals on the bottom row 1620 of contacts in connector receptacle 112 and provide them as outputs 1652. When signals are provided by a rotated connector insert as shown in FIG. 29, the data multiplexers of multiplexers 1650 (MUX 1 and MUX 2) may be placed in the pass-through mode as shown. That is, there is no need to reorder these signals at the output of multiplexers 1650 since the data signals on the connector insert are arranged in a symmetrical manner at the connector insert. The accessory contacts ACCIDT and ACCPWR may be reordered by MUX 3 in multiplexer 1650, which may be placed in a cross mode configuration. When the connector insert is not rotated, as in FIG. 27, the multiplexers 1650 MUX 1, MUX 2, and MUX 3 may each be placed in a pass-through mode and the outputs 2410 are not reordered. In this way, the multiplexers 1650 may reorder the signals on contacts ACCIDT and ACCPWR when the connector insert is rotated, as shown in FIG. 29, to match the signals as they are provided by a non-rotated connector insert, as shown in FIG. 27.

In various embodiments of the present invention, the components of the connector receptacles and connector inserts may be formed in various ways of various materials. For example, contacts and other conductive portions may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the receptacle housings, contact pucks, and other portions, may be formed using injection or other molding, 3-D printing, machining, or other manufacturing process. The nonconductive portions may be formed of silicon or silicone, Mylar, Mylar tape, rubber, hard rubber, plastic, nylon, elastomers, liquid-crystal polymers (LCPs), ceramics, or other nonconductive material or combination of materials.

Embodiments of the present invention may provide connector receptacles and connector inserts that may be located in, and may connect to, various types of devices, such as portable computing devices, tablet computers, desktop computers, laptops, all-in-one computers, wearable computing devices, cell phones, smart phones, media phones, storage devices, keyboards, covers, cases, portable media players, navigation systems, monitors, power supplies, adapters, remote control devices, chargers, and other devices. These connector receptacles and connector inserts may provide pathways for signals that are compliant with various standards such as Universal Serial Bus (USB), High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these connector receptacles and connector inserts may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An electronic device comprising:

a connector receptacle comprising:

a housing having a first plurality of slots and a first opening in a top side and a second plurality of slots and a second opening in a bottom side;

a first plurality of contacts at least partially surrounded by a first contact housing portion, the first plurality of contacts positioned in the first plurality of slots in the housing;

a second plurality of contacts at least partially surrounded by a second contact housing portion, the second plurality of contacts positioned in the second plurality of slots in the housing, wherein the first plurality of contacts form a top row of contacts to receive signals for a universal-serial-bus (USB) 3.0 interface and the second plurality of contacts form a bottom row of contacts to receive signals for a universal-serial-bus (USB) 2.0 interface;

a top shell portion over the top side of the housing, the top shell portion comprising a first electromagnetic contact extending from a front of the top shell portion and passing through the first opening in the top side of the housing; and a bottom shell portion under the bottom side of the housing, the bottom shell portion comprising a second electromagnetic contact extending from a front of the bottom shell portion and passing through the second opening in the bottom side of the housing;

a plurality of switches coupled to the top row of contacts; and a plurality of multiplexers coupled to the bottom row of contacts.

2. The electronic device of claim 1, further comprising a mounting surface where the connector receptacle is attached to the mounting surface and a device enclosure for the electronic device.

3. The electronic device of claim 1, wherein the top shell portion is formed using a deep-drawn process.

4. The electronic device of claim 1, further comprising a U-shaped bracket having contacting portions at each end, wherein contacting portions of the U-shaped bracket are located in side openings in the housing.

5. The electronic device of claim 1, wherein when USB 2.0 signals are present, the plurality of switches are open.

6. The electronic device of claim 5, further comprising a first power supply to provide power when USB 2.0 signals are present and a second power supply to provide power when USB 3.0 signals are present.

7. The electronic device of claim 6, wherein the multiplexers are configured to selectively reverse an order of signals received on the bottom row of contacts.

8. The electronic device of claim 7, further comprising a USB 3.0 controller coupled to the plurality of switches.

9. The electronic device of claim 7, further comprising a USB 3.0 controller, wherein the plurality of switches are coupled between the top row of contacts and the USB 3.0 controller.

10. The electronic device of claim 1, wherein the housing further comprises a third opening in the top side and a fourth opening in the bottom side, the top shell portion further comprises a third electromagnetic contact extending from a front of the top shell portion and passing through the third opening in the top side of the housing, and the bottom shell portion further comprises a fourth electromagnetic contact extending from a front of the bottom shell portion and passing through the fourth opening in the bottom side of the housing.

11. The electronic device of claim 10, wherein the first, second, third, and fourth electromagnetic contacts are folded back at least 180 degrees.

12. An electronic device comprising:

a connector receptacle comprising:

a housing having a first plurality of slots in a top side and a second plurality of slots in a bottom side;

a top row of contacts positioned in the first plurality of slots in the housing;

a bottom row of contacts positioned in the second plurality of slots in the housing, where the top row of contacts receives signals for a universal-serial-bus (USB) 3.0 interface and the bottom row of contacts receives signals for a universal-serial-bus (USB) 2.0 interface;

a top shell portion over the top side of the housing, the top shell portion comprising first and second electromagnetic contacts extending from a front of the top shell portion and passing through corresponding openings in the top side of the housing; and a bottom shell portion under the bottom side of the housing, the bottom shell portion comprising third and fourth electromagnetic contacts extending from a front of the bottom shell portion and passing through corresponding openings in the bottom side of the housing;

a plurality of switches coupled to the top row of contacts; and a plurality of multiplexers coupled to the bottom row of contacts.

13. The electronic device of claim 12, wherein the first, second, third, and fourth electromagnetic contacts are folded back approximately 180 degrees.

14. The electronic device of claim 12, wherein when USB 2.0 signals are present, the plurality of switches are open.

15. The electronic device of claim 12, further comprising a first power supply to provide power when USB 2.0 signals are present and a second power supply to provide power when USB 3.0 signals are present.

16. The electronic device of claim 12, wherein the multiplexers are configured to selectively reverse an order of signals received on the bottom row of contacts.

17. The electronic device of claim 12, further comprising a USB 3.0 controller, wherein the plurality of switches are coupled between the top row of contacts and the USB 3.0 controller.

18. The electronic device of claim 12, further comprising a mounting surface where the connector receptacle is attached to the mounting surface and a device enclosure for the electronic device.

* * * * *